US008668470B2

(12) United States Patent
Bayyouk et al.

(10) Patent No.: US 8,668,470 B2
(45) **Date of Patent: *Mar. 11, 2014**

(54) OFFSET VALVE BORE FOR A RECIPROCATING PUMP

(75) Inventors: Jacob A. Bayyouk, Richardson, TX (US); David M. Manson, Glasgow (GB); Donald Mackenzie, Glasgow (GB); John Bruce Clayfield Davies, Glasgow (GB)

(73) Assignee: S.P.M. Flow Control, Inc., Fort Worth, TX (US)

( * ) Notice: Subject to any disclaimer, the term of this patent is extended or adjusted under 35 U.S.C. 154(b) by 78 days.

This patent is subject to a terminal disclaimer.

(21) Appl. No.: 13/314,745

(22) Filed: Dec. 8, 2011

(65) Prior Publication Data

US 2012/0183424 A1 Jul. 19, 2012

(51) Int. Cl.
*F04B 27/10* (2006.01)
*F04B 39/12* (2006.01)

(52) U.S. Cl.
CPC ..... *F04B 39/122* (2013.01); *F04B 27/10* (2013.01)
USPC ..... 417/269; 417/415

(58) Field of Classification Search
CPC ..... F04B 27/10; F04B 39/122
USPC ..... 417/415, 269; 92/76, 61, 171.1; D15/7, D15/9
See application file for complete search history.

(56) References Cited

U.S. PATENT DOCUMENTS

| | | | |
|---|---|---|---|
| 2,666,026 | A | 1/1954 | Gibbs |
| 2,776,701 | A | 1/1957 | Denis |
| 3,081,252 | A | 3/1963 | Preiser et al. |
| 3,159,559 | A | 12/1964 | Eberhardt, III |
| 3,470,077 | A | 9/1969 | Higgins |
| 3,679,332 | A | 7/1972 | Yohpe |

(Continued)

FOREIGN PATENT DOCUMENTS

| | | | |
|---|---|---|---|
| AR | 084230 | A1 | 5/2013 |
| AR | 084231 | A1 | 5/2013 |

(Continued)

OTHER PUBLICATIONS

B.N. Cole, Strategy for Cross-Bores in High Pressure Containers, pp. 151-176, vol. 11, No. 2, 1969, Journal Mechanical Engineering Science.

(Continued)

*Primary Examiner* — Bryan Lettman
(74) *Attorney, Agent, or Firm* — Haynes and Boone, LLP

(57) ABSTRACT

A fluid end 15 for a multiple reciprocating pump assembly 12 comprises at least three plunger bores 61 or 91, each for receiving a reciprocating plunger 35. Each plunger bore has a plunger bore axis 65 or 95. The plunger bores are arranged across the fluid end to define a central plunger bore with lateral plunger bores located on either side. The fluid end 15 also comprises at least three respective suction valve bores 59 or 89 in fluid communication with the plunger bores. Each suction valve bore can receive a suction valve 41 and has a suction valve bore axis 63 or 93. The fluid end 15 also comprises at least three respective discharge valve bores 57 or 87 that can receive a discharge valve 43 and are in fluid communication with the plunger bores. Axes of suction and discharge valve bores are offset in the fluid.

36 Claims, 15 Drawing Sheets

(56) References Cited

U.S. PATENT DOCUMENTS

| | | | |
|---|---|---|---|
| 3,810,716 | A | 5/1974 | Abrahams et al. |
| 3,844,921 | A | 10/1974 | Benedict |
| 3,919,068 | A | 11/1975 | Gary |
| 3,963,384 | A | 6/1976 | Bastenhof |
| 4,097,357 | A | 6/1978 | Jacquelin |
| 4,339,227 | A | 7/1982 | Furst |
| 4,370,211 | A | 1/1983 | Hybler |
| 4,378,853 | A | 4/1983 | Chia et al. |
| 4,412,792 | A | 11/1983 | LaBorde et al. |
| 4,520,837 | A | 6/1985 | Cole et al. |
| 4,861,241 | A | 8/1989 | Gamboa et al. |
| 5,059,101 | A | 10/1991 | Valavaara |
| 5,102,297 | A | 4/1992 | Thompson |
| 5,127,807 | A | 7/1992 | Eslinger |
| 5,154,589 | A | 10/1992 | Ruhl et al. |
| 5,171,136 | A | 12/1992 | Pacht |
| 5,246,355 | A | 9/1993 | Matzner et al. |
| D355,199 | S | 2/1995 | Ousey |
| D361,575 | S | 8/1995 | Makino |
| 5,584,672 | A | 12/1996 | Simonette |
| 5,636,975 | A | 6/1997 | Tiffany et al. |
| 5,639,227 | A | 6/1997 | Mills |
| 5,823,541 | A | 10/1998 | Dietle et al. |
| 5,839,468 | A | 11/1998 | Allred |
| 5,848,878 | A | 12/1998 | Conti et al. |
| 5,947,697 | A | 9/1999 | Morrison |
| D420,683 | S | 2/2000 | Suzuki |
| 6,065,453 | A | 5/2000 | Zych |
| 6,382,940 | B1 | 5/2002 | Blume |
| 6,386,751 | B1 | 5/2002 | Wootan et al. |
| D461,733 | S | 8/2002 | Iida |
| D461,827 | S | 8/2002 | Koebbe |
| 6,544,012 | B1 | 4/2003 | Blume |
| 6,595,278 | B1 | 7/2003 | Lam et al. |
| 6,623,259 | B1 | 9/2003 | Blume |
| 6,670,312 | B2 | 12/2003 | Sugimoto et al. |
| 6,705,396 | B1 | 3/2004 | Ivannikov et al. |
| 6,843,313 | B2 | 1/2005 | Hult |
| D506,210 | S | 6/2005 | Selic et al. |
| 6,910,871 | B1 | 6/2005 | Blume |
| 7,036,688 | B2 | 5/2006 | Stettes et al. |
| 7,118,114 | B2 | 10/2006 | Burdick et al. |
| 7,186,097 | B1 | 3/2007 | Blume |
| 7,255,163 | B2 | 8/2007 | Rivard |
| D552,139 | S | 10/2007 | Cho |
| D556,861 | S | 12/2007 | Yokohari |
| D556,862 | S | 12/2007 | Yokohari |
| D557,286 | S | 12/2007 | Pedrollo |
| 7,335,002 | B2 | 2/2008 | Vicars |
| 7,364,412 | B2 | 4/2008 | Kugelev et al. |
| 7,404,704 | B2 | 7/2008 | Kugelev et al. |
| D583,389 | S | 12/2008 | Bilger |
| D584,320 | S | 1/2009 | Huang |
| 7,484,452 | B2 | 2/2009 | Baxter et al. |
| 7,513,759 | B1 | 4/2009 | Blume |
| D603,870 | S | 11/2009 | Mehnert et al. |
| D605,665 | S | 12/2009 | Falkenberg |
| D606,629 | S | 12/2009 | Tokumoto |
| D623,200 | S | 9/2010 | Fulkerson et al. |
| D629,423 | S | 12/2010 | Varini |
| 7,874,369 | B2 | 1/2011 | Parker et al. |
| D641,382 | S | 7/2011 | Hawes et al. |
| 8,016,027 | B2 | 9/2011 | Boyles |
| 1,331,483 | A1 | 12/2011 | Bayyouk et al. |
| 8,074,999 | B2 | 12/2011 | Burdick et al. |
| D655,314 | S | 3/2012 | Yoshimura et al. |
| D657,799 | S | 4/2012 | Jung |
| 8,147,227 | B1 | 4/2012 | Blume |
| D660,191 | S | 5/2012 | Asaba |
| D667,532 | S | 9/2012 | Asaba |
| D670,312 | S | 11/2012 | Alexander et al. |
| D670,790 | S | 11/2012 | Tokumoto |
| D676,111 | S | 2/2013 | Fukano et al. |
| D679,290 | S | 4/2013 | Skurdalsvold |
| D679,292 | S | 4/2013 | DeLeon et al. |
| D679,293 | S | 4/2013 | DeLeon et al. |
| 2003/0235508 | A1 | 12/2003 | Vicars |
| 2004/0219042 | A1 | 11/2004 | Kugelev et al. |
| 2006/0002806 | A1 | 1/2006 | Baxter et al. |
| 2006/0159573 | A1 | 7/2006 | Inoue et al. |
| 2007/0051508 | A1 | 3/2007 | Pecorari et al. |
| 2007/0237651 | A1* | 10/2007 | Tojo ..... 417/269 |
| 2008/0003122 | A1 | 1/2008 | Tian et al. |
| 2008/0138224 | A1 | 6/2008 | Vicars |
| 2009/0314645 | A1 | 12/2009 | Kim |
| 2010/0322802 | A1 | 12/2010 | Kugelev |
| 2011/0189040 | A1 | 8/2011 | Vicars |
| 2011/0198072 | A1 | 8/2011 | Cote et al. |
| 2011/0308967 | A1 | 12/2011 | Byrne |
| 2012/0063936 | A1 | 3/2012 | Baxter et al. |
| 2012/0144995 | A1 | 6/2012 | Bayyouk et al. |
| 2012/0183424 | A1 | 7/2012 | Bayyouk et al. |
| 2012/0288387 | A1 | 11/2012 | Freed et al. |

FOREIGN PATENT DOCUMENTS

| | | | | |
|---|---|---|---|---|
| AU | 343913 | | 8/2012 | |
| AU | 343914 | | 8/2012 | |
| AU | 346409 | | 1/2013 | |
| CA | 2486223 | | 9/2010 | |
| CA | 2350047 | C | 10/2010 | |
| CA | 138269 | | 7/2011 | |
| CA | 2514769 | | 9/2011 | |
| CA | 2716430 | C | 5/2012 | |
| CA | 144435 | | 9/2012 | |
| CA | 2711206 | C | 9/2012 | |
| CN | 201148968 | | 11/2008 | |
| CN | 101397672 | | 4/2009 | |
| CN | ZL201030691447 | | 2/2012 | |
| CN | ZL201230031196.2 | | 12/2012 | |
| CN | ZL201230337093.9 | | 3/2013 | |
| CN | ZL201230324855.1 | | 5/2013 | |
| CN | ZL201230513325.1 | | 5/2013 | |
| DE | 10214404 | | 10/2003 | |
| EM | 001944054-0001 | | 2/2012 | |
| EM | 001335699-0001 | | 9/2012 | |
| EM | 001335699-0002 | | 9/2012 | |
| EM | 002125732-0001 | | 1/2013 | |
| EP | 0580196 | | 1/1994 | |
| EP | 1780415 | * | 5/2007 | ..... F04B 53/16 |
| GB | 1449280 | | 9/1976 | |
| GB | 2419642 | | 5/2006 | |
| GB | 2416811 | | 9/2009 | |
| IN | 243221 | | 2/2012 | |
| IN | 246712 | | 7/2012 | |
| JP | 2000170643 | | 6/2000 | |
| RU | 2168064 | C2 | 5/2001 | |
| SA | 2446 | | 9/2012 | |
| SG | D2012/168 | I | 2/2012 | |
| SG | D2012/874/J | | 9/2012 | |
| SG | D2012/875 | G | 9/2012 | |
| SG | D2012/1221/J | | 10/2012 | |
| WO | WO 2004/092538 | | 10/2004 | |
| WO | WO 2005/015024 | | 2/2005 | |
| WO | WO2005088125 | A1 | 9/2005 | |
| WO | WO 2011/018732 | | 2/2011 | |
| WO | WO 2011/027273 | | 3/2011 | |
| WO | WO 2011/054948 | | 5/2011 | |
| WO | WO 2011/160069 | | 12/2011 | |
| WO | WO 2012/078870 | | 6/2012 | |
| WO | WO 2012/078888 | | 6/2012 | |
| WO | WO 2012/145591 | | 10/2012 | |

OTHER PUBLICATIONS

P. Makulsawatudom, et al., Stress Concentration at Crossholes in thick Cylindrical Vessels, pp. 471-481, J. Strain Analysis vol. 39 No. 5.

L.M. Masu, Cross Bore Configuration and Size Effects on the Stress Distribution in Thick-Walled Cylinders, pp. 171-176, Int. J. Pres Ves. & Piping 72 (1977).

U.S. Appl. No. 29/399,897, filed Sep. 18, 2011, S.P.M. Flow Control, Inc.

(56) References Cited

OTHER PUBLICATIONS

U.S. Appl. No. 29/411,974, filed Jan. 27, 2012, S.P.M. Flow Control, Inc.
U.S. Appl. No. 29/419,417, filed Apr. 27, 2012, S.P.M. Flow Control, Inc.
U.S. Appl. No. 29/419,425, filed Apr. 27, 2012, S.P.M. Flow Control, Inc.
U.S. Appl. No. 29/420,822, filed May 14, 2012, S.P.M. Flow Control, Inc.
U.S. Appl. No. 29/424,801, filed Jun. 15, 2012, S.P.M. Flow Control, Inc.
U.S. Appl. No. 29/425,284, filed Jun. 21, 2012, S.P.M. Flow Control, Inc.
L.M. Masu; Numerical analysis of cylinders containing circular off-set cross-bores—Abstract; International Journal of Pressure Vessels and Piping, vol. 75, Issue 3, Mar. 1998.
Xie He et al.; Fatigue Prediction for Pump End of High Pressure Fracturing Pump; Advanced Materials Research vol. 337 (2011) pp. 81-86.
A. Al-Hashem et al., Cavitation Corrosion Behavior of Some Cast Alloys in Seawater, from Industrial Corrosion and Corrosion Control Technology, Pub. By Kuwait Institute for Science.
Notice of Allowance mailed Dec. 12, 2007, by the USPTO, regarding U.S. Appl. No. 10/913,221, now Patent No. 7,364,412.
Examiner Interview Summary mailed Oct. 9, 2007, by the USPTO, regarding U.S. Appl. No. 10/913,221, now Patent No. 7,364,412.
Final Office Action mailed Jul. 20, 2007, by the USPTO, regarding U.S. Appl. No. 10/913,221, now Patent No. 7,364,412.
Office Action mailed Mar. 29, 2007, by the USPTO, regarding U.S. Appl. No. 10/913,221, now Patent No. 7,364,412.
Notice of Allowance mailed Mar. 27, 2008, by the USPTO, regarding U.S. Appl. No. 10/835,749, now Patent No. 7,404,704.
Office Action mailed Jan. 10, 2008, by the USPTO, regarding U.S. Appl. No. 10/835,749, now Patent No. 7,404,704.
Office Action mailed Jun. 21, 2007, by the USPTO, regarding U.S. Appl. No. 10/835,749, now Patent No. 7,404,704.
Office Action mailed Apr. 25, 2013, by the USPTO, regarding U.S. Appl. No. 13/162,815.
Office Action mailed Nov. 9, 2010, re Design U.S. Appl. No. 29/363,376, now Patent No. D641,382.
Notice of Allowance mailed Mar. 8, 2011, re Design U.S. Appl. No. 29/363,376, now Patent No. D641,382.
Notice of Allowance mailed Apr. 18, 2013, by the USPTO, regarding Design U.S. Appl. No. 29/399,897.
Office Action mailed Jul. 23, 2012, by the USPTO, regarding Design U.S. Appl. No. 29/411,974.
Office Action mailed Nov. 6, 2012, by the USPTO, regarding Design U.S. Appl. No. 29/411,974.
Notice of Allowance mailed Jan. 10, 2013, by the USPTO, regarding Design U.S. Appl. No. 29/411,974.
Notice of Allowance mailed Jan. 18, 2013, by the USPTO, regarding Design U.S. Appl. No. 29/419,417.
Notice of Allowance mailed Jan. 23, 2013, by the USPTO, regarding Design U.S. Appl. No. 29/419,425.
Notice of Allowance mailed Apr. 12, 2013, by the USPTO, regarding Design U.S. Appl. No. 29/420,822.
Search Report, dated Oct. 31, 2005, from the UK Patent Office regarding App No. GB0516137.7.
Search Report, dated Jan. 18, 2005, from the UK Patent Office regarding App No. GB0424019.8.
Examination Report issued by Intellectual Property India, dated Aug. 31, 2012, regarding Indian Design Application No. 246713.
Examination Report issued by Intellectual Property India, dated Mar. 28, 2013, regarding Indian Design Application No. 246713.
Examination Report issued by Intellectual Property India, dated Sep. 14, 2012, regarding Indian Design Application No. 246712.
Examination Report issued by Intellectual Property India, dated Jan. 3, 2013, regarding Indian Design Application No. 248994.
Canadian Examiner's Report issued by the CIPO, dated Jan. 10, 2013, regarding App No. 146,660.
International Preliminary Report on Patentability, issued Dec. 19, 2012, by the International Bureau of WIPO, in connection with International Application No. PCT/US2011/040960.
International Search Report and Written Opinion, mailed Nov. 1, 2011, by the ISA/US, in connection with International Application No. PCT/US2011/040960.
International Search Report and Written Opinion, mailed Jul. 20, 2012, by the ISA/KR, in connection with International Application No. PCT/US2011/063946.
International Search Report and Written Opinion, mailed Jul. 20, 2012, by the ISA/KR, in connection with International Application No. PCT/US2011/063968.
International Search Report and Written Opinion, mailed Jun. 29, 2012, by the ISA/US, in connection with International Application No. PCT/US2012/034397.
Co-pending U.S. Appl. No. 29/461,771, filed Jul. 26, 2013.
International Search Report and Written Opinion issued Apr. 8, 2013, by the ISA/US, regarding PCT/US2013/024172.
Notice of Allowance mailed Jul. 26, 2013, by the USPTO, regarding U.S. Appl. No. 29/445,736.
Notice of Allowance mailed May 29, 2013, by the USPTO, regarding U.S. Appl. No. 29/425,284.
Office Action mailed Aug. 14, 2013, by the USPTO, regarding U.S. Appl. No. 13/849,228.
Office Action mailed Jul. 17, 2013, by the USPTO, regarding U.S. Appl. No. 29/420,822.
Office Action mailed Jul. 22, 2013, by the USPTO, regarding U.S. Appl. No. 13/314,831.

* cited by examiner

OFFSET VALVE BORE FOR A RECIPROCATING PUMP

CROSS-REFERENCE TO RELATED APPLICATIONS

This application claims priority to provisional application 61/421,453 filed Dec. 9, 2010.

TECHNICAL FIELD

An arrangement is disclosed whereby a valve bore is offset from a plunger bore in a fluid end of a reciprocating pump to relieve stress.

BACKGROUND OF THE DISCLOSURE

In oil field operations, reciprocating pumps are used for various purposes. Reciprocating pumps are used for operations such as cementing, acidizing, or fracturing of a subterranean well. These reciprocating pumps run for relatively short periods of time, but they operate on a frequent basis and oftentimes at extremely high pressures. A reciprocating pump is mounted to a truck or a skid for transport to various well sites and must be of appropriate size and weight for road and highway regulations.

Reciprocating pumps or positive displacement pumps for oil field operations deliver a fluid or slurry, which may carry solid particles (for example, a sand proppant), at pressures up to 20,000 psi to the wellbore. A known pump for oilfield operations includes a power end driving more than one plunger reciprocally in a corresponding fluid end or pump chamber. The fluid end may comprise three or five plunger bores arranged transversely across a fluid head, and each plunger bore may be intersected by suction and discharge valve bores. In a known reciprocating pump, the axis of each plunger bore intersects perpendicularly with a common axis of the suction and discharge valve bores.

In a mode of operating a known three plunger bore reciprocating pump at high fluid pressures (for example, around or greater than 20,000 psi), a maximum pressure and thus stress can occur within a given pump chamber as the plunger moves longitudinally in the fluid end towards top dead center (TDC), compressing the fluid therein. One of the other pump chambers will be in discharge and thus at a very low pressure, and the other pump chamber will have started to compress the fluid therein.

It has been discovered that, in a given pump chamber, the areas of highest stress occur at the intersection of each plunger bore with its suction and discharge valve bores as the plunger moves to TDC. The occurrence of high stress at these areas can shorten the life of the fluid end.

JP 2000-170643 is directed to a multiple reciprocating pump having a small size. The pump has three piston bores in which the pistons reciprocate but, so that a compact pump configuration can be provided, the axis of each suction valve bore is arranged perpendicularly to its respective discharge valve bore (that is, so that there is a laterally directed discharge from the fluid end).

JP 2000-170643 also teaches that a limit as to the volume of fluid that can be pumped by a small reciprocating pump is the size of suction and discharge valve bores. Contrary to the embodiments disclosed herein, the teaching of JP 2000-170643 is not concerned with reducing stresses arising at the intersection of piston, suction and discharge bores. Rather, JP 2000-170643 teaches moving the axes of each of the outside suction and discharge valve bores outwardly with respect to their plunger bore axis to enable the volume of each of the suction and discharge valve bores to be increased. Thus, with an increased pump speed, an increased volumetric flow can be achieved with a pump that still has a similar overall dimensional profile. In addition, JP 2000-170643 teaches that the valve bores are moved outwardly without increasing the amount of material between the suction and discharge bores. This is because the reconfiguration of the pump in JP 2000-170643 is not concerned with reducing stresses within the pump in use.

SUMMARY

In a first aspect there is disclosed a fluid end for a multiple reciprocating pump assembly. The multiple reciprocating pump assembly may, for example, comprise three or five plunger bores, and may find application in oilfield operations and/or may operate with fluids at high pressures (for example, as high as 20,000 psi or greater). The fluid end comprises at least three plunger bores (for example, three or five plunger bores), each can receive a reciprocating plunger, and each can have a plunger bore axis. The plunger bores can be arranged across the fluid end to define a central plunger bore and lateral plunger bores located on either side of the central plunger bore (for example, one or two lateral plunger bores located on either side of the central plunger bore, to define a fluid end with three or five plunger bores respectively). At least three respective suction valve bores (for example, three or five suction valve bores) can be provided for and be in fluid communication with the plunger bores. Each suction valve bore can receive a suction valve and have a suction valve bore axis. At least three respective discharge valve bores (e.g. three or five discharge valve bores) can be provided for and be in fluid communication with the plunger bores. Each discharge valve bore can receive a discharge valve and have a discharge valve bore axis. In accordance with the first aspect, at least one of the axes of at least one of the suction and discharge valve bores is offset in the fluid end from its respective plunger bore axis. The offset can be such that overall stress within the fluid in use is reduced (e.g. as the plunger moves to TDC). This reduction in overall stress is a surprising discovery, with an outcome that the useful operating life of the fluid end can be increased.

In certain embodiments for each of the plunger bores, the suction valve bore may oppose the discharge valve bore. This arrangement is easier to manufacture, maintain and service than, for example, arrangements in which the axis of each suction valve bore is e.g. perpendicular to the discharge valve bore. In addition, the opposing bore arrangement may induce less stress in the fluid end in use than, for example, a perpendicular bore arrangement.

In certain embodiments for each of the plunger bores, the axes of the suction and discharge valve bores may be aligned, for even greater ease of manufacture, maintenance and service. In other certain embodiments, the at least one offset axis may be offset in an amount ranging from about 10% to about 60% of the diameter of the plunger bore. In certain other embodiments, the offset axis may be offset in an amount ranging from about 20% to about 50%, or from about 30% to about 40%, of the diameter of the plunger bore.

In other certain embodiments, the at least one offset axis may be offset in an amount ranging from about 0.5 to about 2.5 inches. In certain other embodiments, the offset axis may be offset in an amount ranging from about 1.5 to 2.5 inches. These dimensions may represent an optimal range for many bore diameters of fluid end configurations employed in fracking pumps in oilfield and related applications.

In a second aspect, there is provided a fluid end for a multiple reciprocating pump assembly. The fluid end comprises at least three plunger bores each for receiving a reciprocating plunger, with each plunger bore having a plunger bore axis. The plunger bores are arranged across the fluid end to define a central plunger bore and lateral plunger bores located on either side of the central plunger bore. At least three respective suction valve bores are in fluid communication with the plunger bores. Each suction valve bore is able to receive a suction valve and has a suction valve bore axis. At least three respective discharge valve bores are in fluid communication with the plunger bores. Each discharge valve bore is able to receive a discharge valve and has a discharge valve bore axis. In accordance with the second aspect at least one of the axes of at least one of the suction and discharge valve bores is offset in the fluid end from its respective plunger bore axis in such a manner that overall stress within the fluid end in use is reduced. This reduction in overall stress is a surprising discovery with an outcome that the useful operating life of the fluid end can be increased.

In certain embodiments for each of the plunger bores, the suction valve bore may oppose the discharge valve bore.

In certain embodiments for each of the plunger bores, the axes of the suction and discharge valve bores may be aligned.

In other certain embodiments, the at least one offset axis may be offset in an amount ranging from about 10% to about 60% of the diameter of the plunger bore. In certain other embodiments, the offset axis may be offset in an amount ranging from about 20% to about 50%, or from about 30% to about 40%, of the diameter of the plunger bore.

In other certain embodiments, the at least one offset axis may be offset in an amount ranging from about 0.5 to about 2.5 inches. In certain other embodiments, the offset axis may be offset in an amount ranging from about 1.5 to 2.5 inches. These dimensions may represent an optimal range for many bore diameters of fluid end configurations employed in fracking pumps in oilfield and related applications.

In a third aspect, there is provided a fluid end for a multiple reciprocating pump assembly. The fluid end comprises at least three plunger bores each for receiving a reciprocating plunger. Each plunger bore has a plunger bore axis, with the plunger bores being arranged across the fluid end to define a central plunger bore and lateral plunger bores located on either side of the central plunger bore. At least three respective suction valve bores are in fluid communication with the plunger bores. Each suction valve bore is able to receive a suction valve and has a suction valve bore axis. At least three respective discharge valve bores are in fluid communication with the plunger bores. Each discharge valve bore is able to receive a discharge valve and has a discharge valve bore axis. Each discharge valve bore opposes a respective suction valve bore. In accordance with the third aspect, at least one of the axes of at least one of the suction and discharge valve bores is offset in the fluid end from its respective plunger bore axis.

In certain embodiments for each of the plunger bores, the axes of the suction and discharge valve bores may be aligned.

In other certain embodiments, the at least one offset axis may be offset in an amount ranging from about 10% to about 60% of the diameter of the plunger bore. In certain other embodiments, the offset axis may be offset in an amount ranging from about 20% to about 50%, or from about 30% to about 40%, of the diameter of the plunger bore.

In other certain embodiments, the at least one offset axis may be offset in an amount ranging from about 0.5 to about 2.5 inches. In certain other embodiments, the offset axis may be offset in an amount ranging from about 1.5 to 2.5 inches. These dimensions may represent an optimal range for many bore diameters of fluid end configurations employed in fracking pumps in oilfield and related applications.

In certain embodiments at least one of the axes of the suction and discharge valve bores for each of the lateral plunger bores may be inwardly or outwardly offset. For example, for a three or five plunger bore fluid end that has a central plunger bore (such as may be arranged on a central axis of the fluid end), the inward or outward offset may comprise a lateral offset (that is, towards or away from a given one of the sides of the fluid end). The offset may, in addition, be with respect to an axis of the central plunger bore, or in further embodiments with respect to the central axis of the fluid end in the case of offsetting a central suction and/or discharge valve bore.

In certain embodiments, for the lateral plunger bores, for reasons of uniformity of design and stress reduction in the fluid end, the at least one offset axis may be inwardly or outwardly offset to the same extent as the other at least one offset axis.

In certain embodiments, the axes of both the suction and discharge valve bores may be inwardly or outwardly offset.

In certain embodiments, the axes of both the suction and discharge valve bores may be inwardly or outwardly offset to the same extent.

In other certain embodiments, the fluid end may comprise three or five plunger bores, and three or five corresponding suction and discharge valve bores.

In a fourth aspect, there is provided a fluid end for a multiple reciprocating pump assembly. The fluid end comprises first and second opposing sides having a longitudinal dimension, first and second opposing end surfaces, a top surface having a longitudinal dimension, and a bottom surface having a longitudinal dimension. At least three plunger bores are provided, each for receiving a reciprocating plunger, and each plunger bore having a plunger bore axis. The plunger bores are arranged across the fluid end to define a central plunger bore and lateral plunger bores located on either side of the central plunger bore. At least three respective suction valve bores are in fluid communication with the plunger bores. Each suction valve bore is able to receive a suction valve and has a suction valve bore axis. At least three respective discharge valve bores are in fluid communication with the plunger bores. Each discharge valve bore is able to receive a discharge valve and has a discharge valve bore axis. In accordance with the fourth aspect at least one of the axes of at least one of the suction and discharge valve bores is offset in the fluid end from its respective plunger bore axis. The offset can be such that overall stress within the fluid end in use is reduced (for example as the plunger moves to TDC). Again this reduction in overall stress is a surprising discovery with an outcome that the useful operating life of the fluid end can be increased.

In certain embodiments for each of the plunger bores, the suction valve bore may oppose the discharge valve bore.

In other certain embodiments for each of the plunger bores, the axes of the suction and discharge valve bores may be aligned.

In other certain embodiments, the at least one offset axis may be offset in an amount ranging from about 10% to about 60% of the diameter of the plunger bore. In certain other embodiments, the offset axis may be offset in an amount ranging from about 20% to about 50%, or from about 30% to about 40%, of the diameter of the plunger bore.

In other certain embodiments, the at least one offset axis may be offset in an amount ranging from about 0.5 to about 2.5 inches. In certain other embodiments, the offset axis may be offset in an amount ranging from about 1.5 to 2.5 inches.

These dimensions may represent an optimal range for many bore diameters of fluid end configurations employed in fracking pumps in oilfield and related applications.

In certain embodiments, at least one of the first and second end surfaces may further comprise an end support. The end support may be configured such that overall stress within the fluid in use is reduced. The end support may comprise the arrangement or addition of further material (for example, metal) to the fluid end.

In other certain embodiments, the end support may add from about 0.1% to about 25% to a portion of the longitudinal dimension of the first and second opposing sides.

In certain embodiments, the end support may cover from about 20% to about 80% of the surface on at least one of the first and second ends. In certain other embodiments the end support may cover from about 30% to about 70%, or from about 40% to about 60%, or around 50% of the surface on at least one of the first and second ends.

In other certain embodiments, the end support may cover the entire surface on at least one of the first and second ends.

In certain embodiments, the longitudinal dimension of the bottom surface may be greater than the longitudinal dimension of the top surface.

Other aspects, features, and advantages will become apparent from the following detailed description when taken in conjunction with the accompanying drawings, which are a part of this disclosure and which illustrate, by way of example, principles of the fluid end as disclosed herein.

DESCRIPTION OF THE FIGURES

Notwithstanding any other forms which may fall within the scope of the fluid end as set forth in the Summary, specific embodiments of the fluid end and reciprocating pump will now be described, by way of example only, with reference to the accompanying drawings.

In the Description of the Figures and in the Detailed Description of Specific Embodiments, a pump that comprises three plunger, suction and discharge bores is hereafter referred to as a "triplex", and a pump that comprises five plunger, suction and discharge bores is hereafter referred to as a "quint", being an abbreviation of "quintuplex".

In the drawings:

FIGS. 1A and 1B illustrate, in sectional and perspective views, an embodiment of a reciprocating pump. FIG. 1A may depict either a triplex or quint, although FIG. 1B specifically depicts a triplex.

FIGS. 1C and 1D illustrate, in end and perspective views, an embodiment of a triplex fluid end for a reciprocating pump, in which cover plates have been removed for clarity, to illustrate the provision of end supports on opposing sides of the fluid end.

Figure 1A:
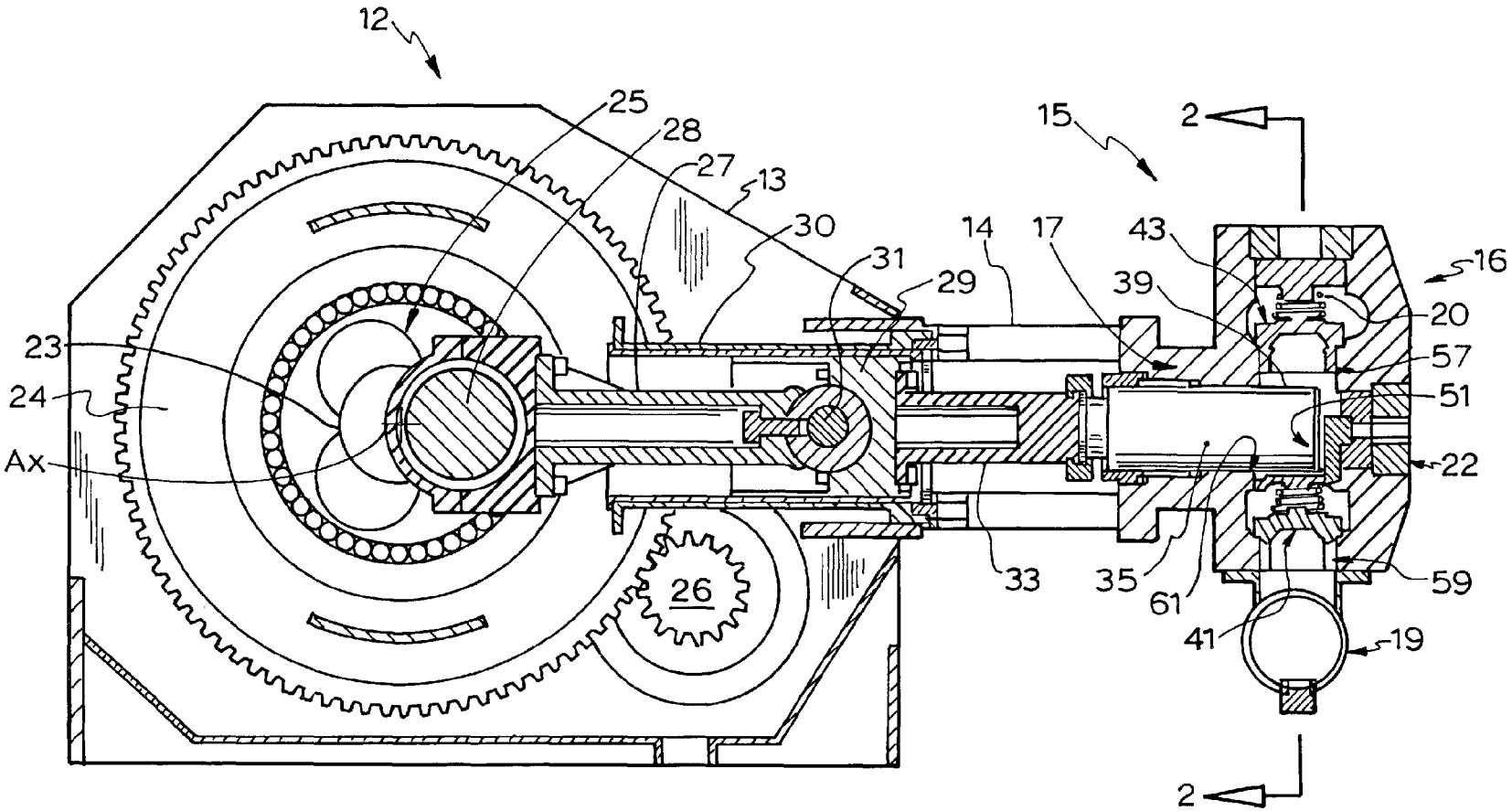
Figure 2:
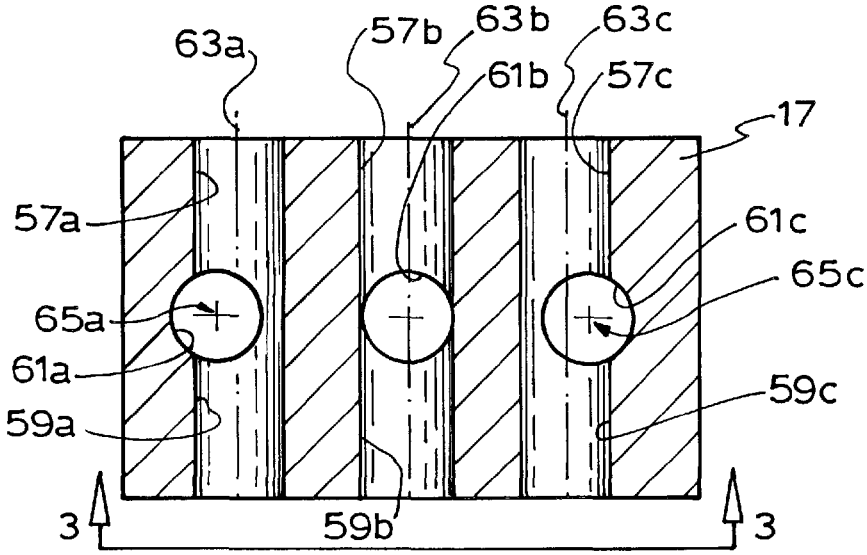

FIG. 2 schematically depicts an embodiment of a triplex, being a partial section of FIG. 1A taken on the line 2-2, to illustrate both lateral (or outside) valve bore pairs being offset inwardly from their respective plunger bores.

Figure 3:
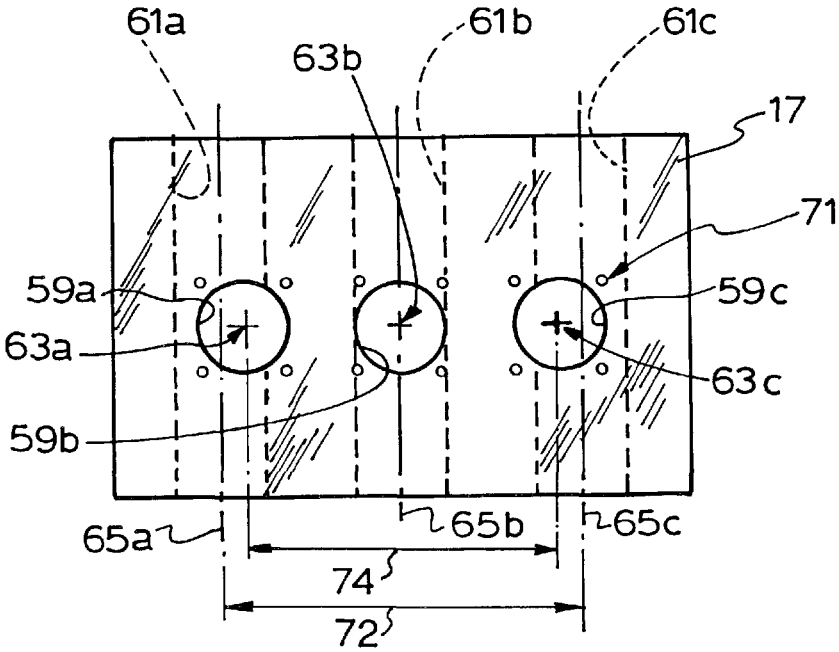

FIG. 3 is an underside schematic view of the section of FIG. 2 to show a bolt pattern on a fluid end.

Figure 4:
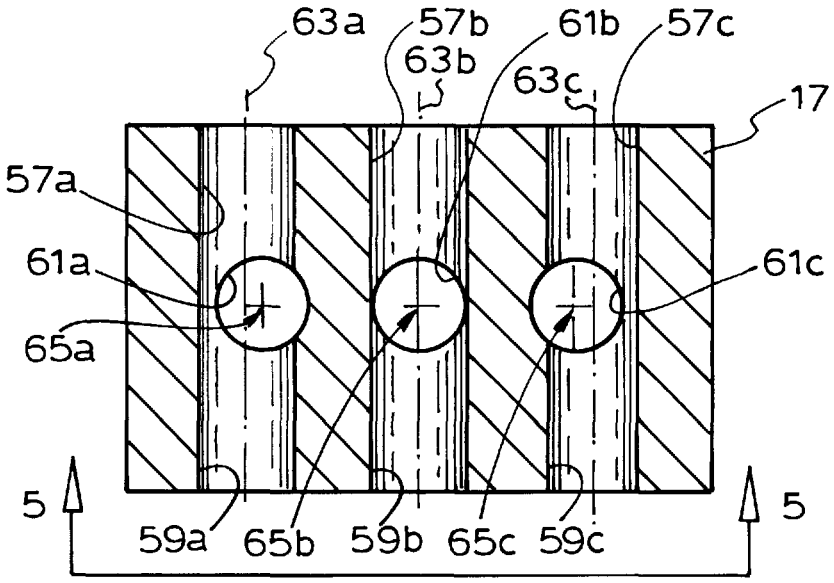

FIG. 4 schematically depicts another embodiment of a triplex, being a partial section similar to FIG. 2, to illustrate some of the valve bores outwardly offset from their respective plunger bores.

Figure 5:
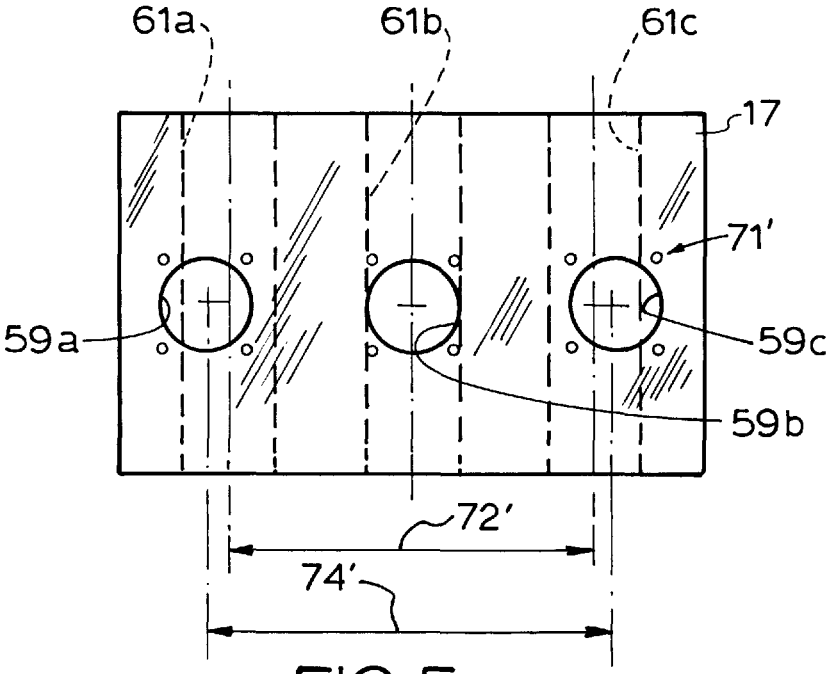

FIG. 5 is an underside schematic view of the section of FIG. 4 to show a bolt pattern on a fluid end of a cylinder.

Figure 6:
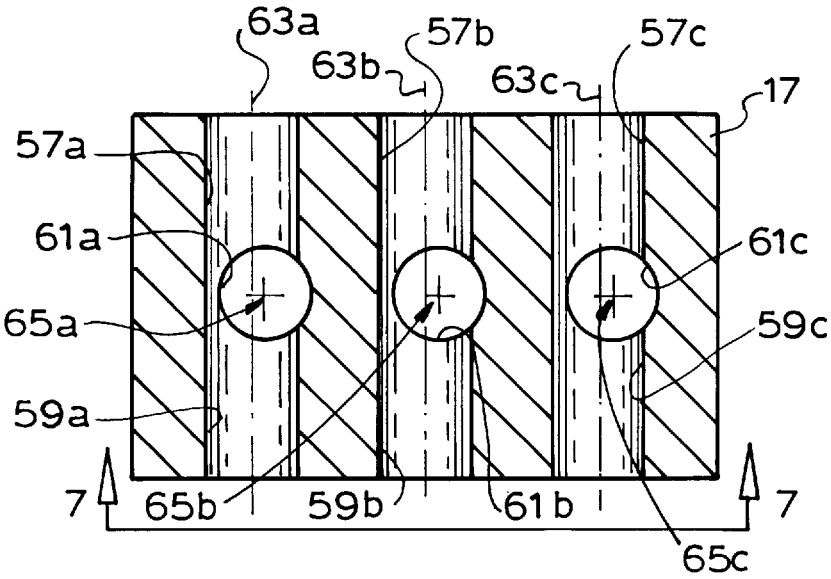

FIG. 6 schematically depicts another embodiment of a triplex, being a partial section similar to FIG. 2 to illustrate the valve bores offset to the left of their respective plunger bores.

Figure 7:
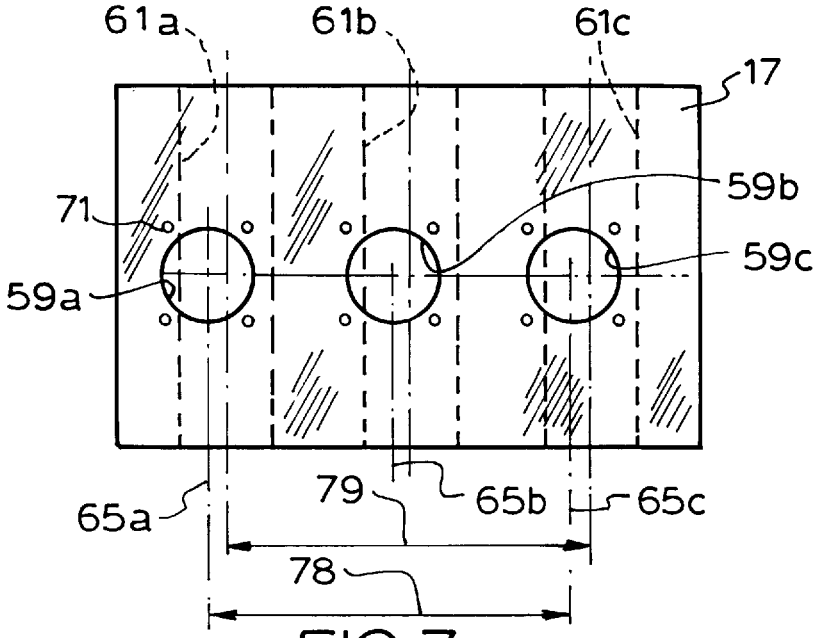

FIG. 7 is an underside schematic view of the section of FIG. 6 to show a bolt pattern on a fluid end of a cylinder.

Figure 8:
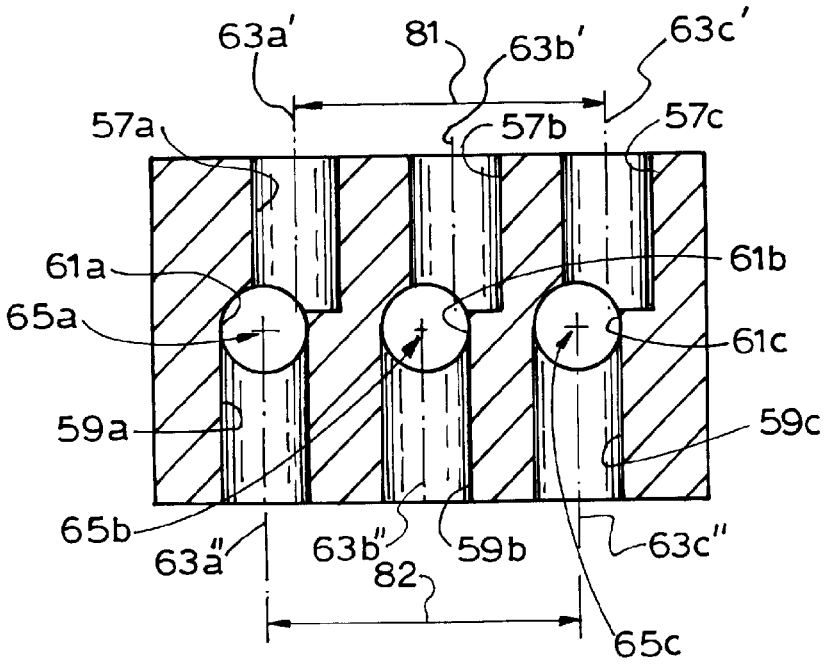

FIG. 8 schematically depicts another embodiment of a triplex, being a partial section similar to FIG. 2 to illustrate discharge valve bores offset from respective plunger bores.

Figure 9:
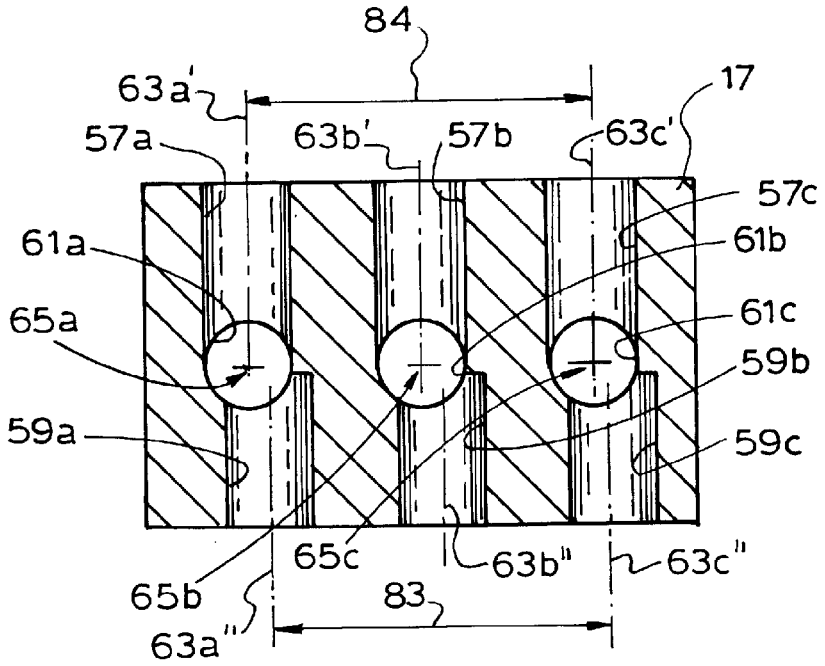

FIG. 9 schematically depicts another embodiment of a triplex, being a partial section similar to FIG. 2 to illustrate suction valve bores offset from respective plunger bores.

Figure 10:
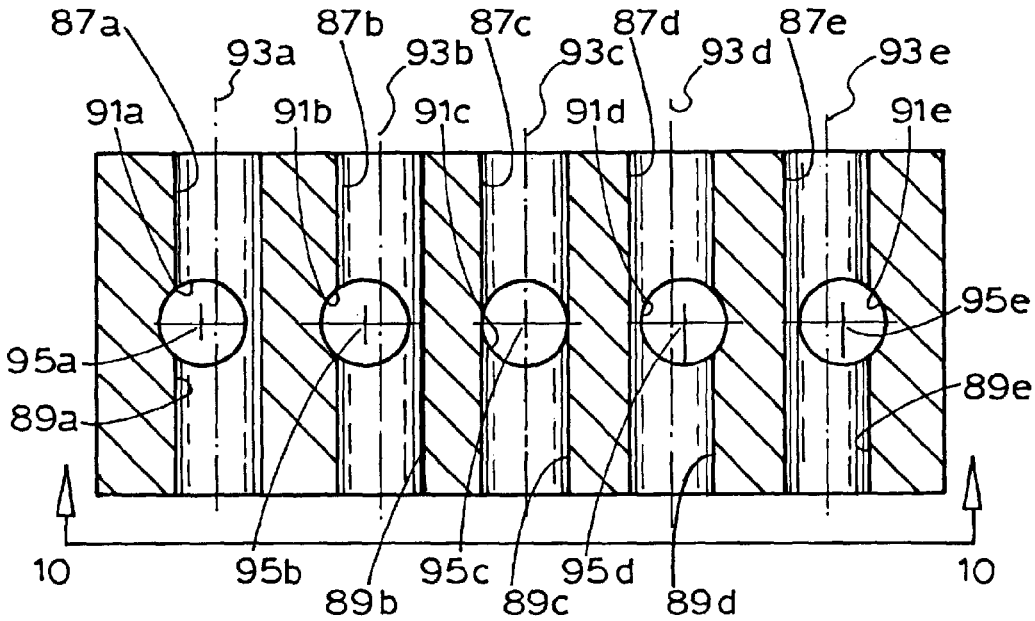

FIG. 10 schematically depicts a first embodiment of a quint, being a partial section of FIG. 1A taken on the line 2-2, to illustrate the two lateral valve bore pairs on either side of the central valve bore pair being offset inwardly from their respective plunger bores.

Figure 11:
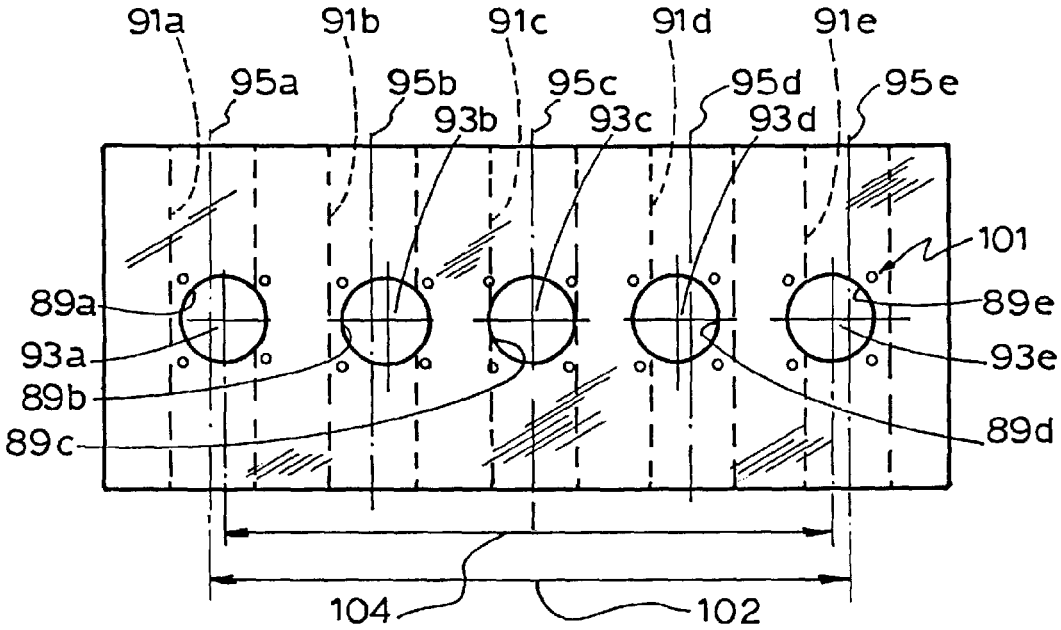

FIG. 11 is an underside schematic view of the section of FIG. 10 to show a bolt pattern on a fluid end of a cylinder.

Figure 12:
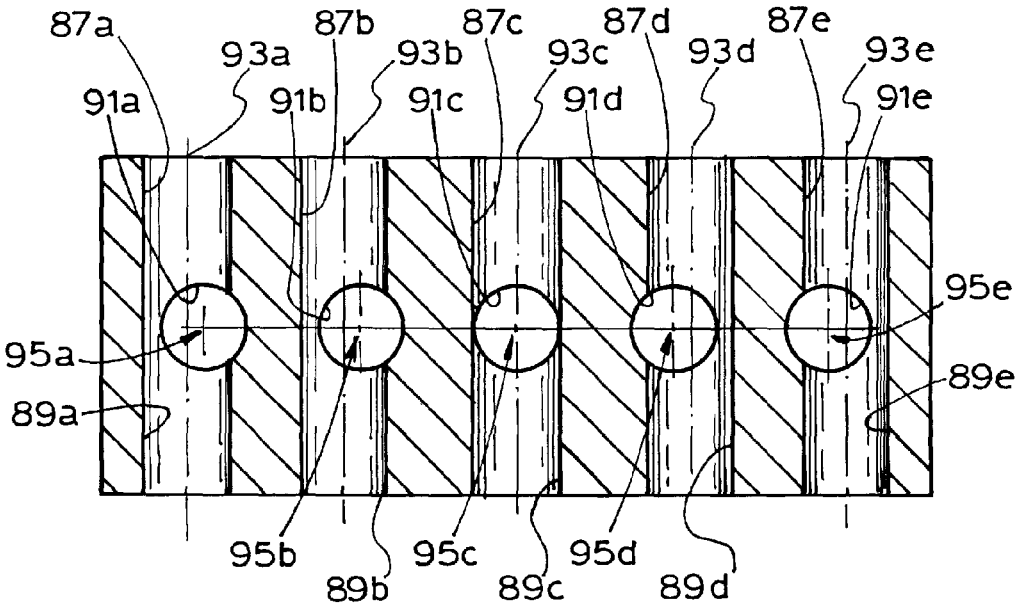

FIG. 12 is a similar view of the quint of FIG. 10, but illustrates both the innermost and outermost lateral valve bore pairs, and not the central valve bore pair, being offset outwardly from their respective plunger bores.

Figure 13:
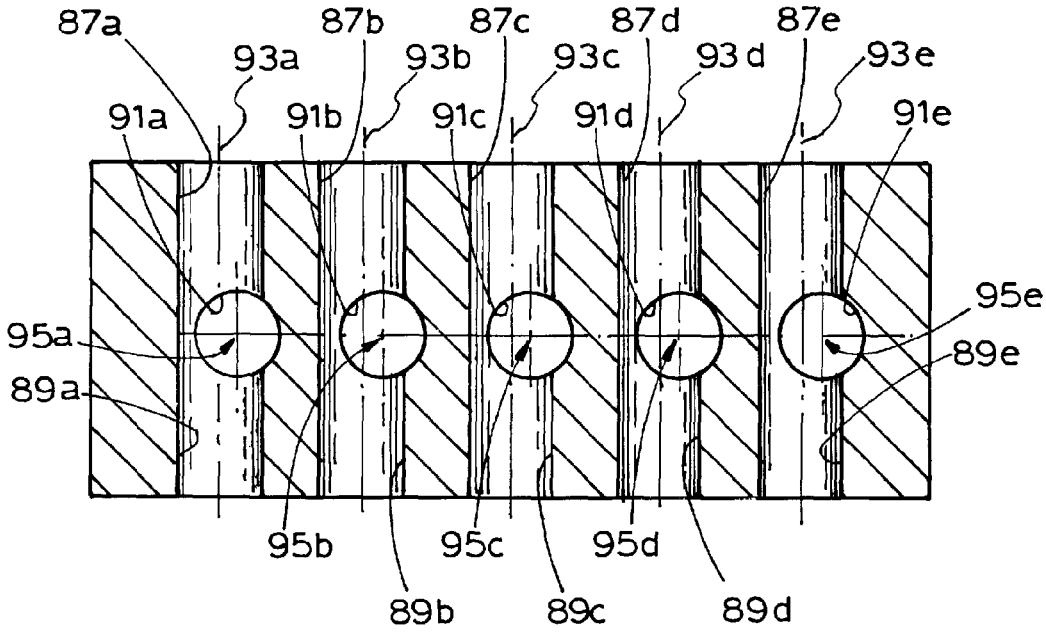

FIG. 13 is a similar view of the quint of FIG. 10, but illustrates all the valve bore pairs being offset to the left of their respective plunger bores.

Figure 14:
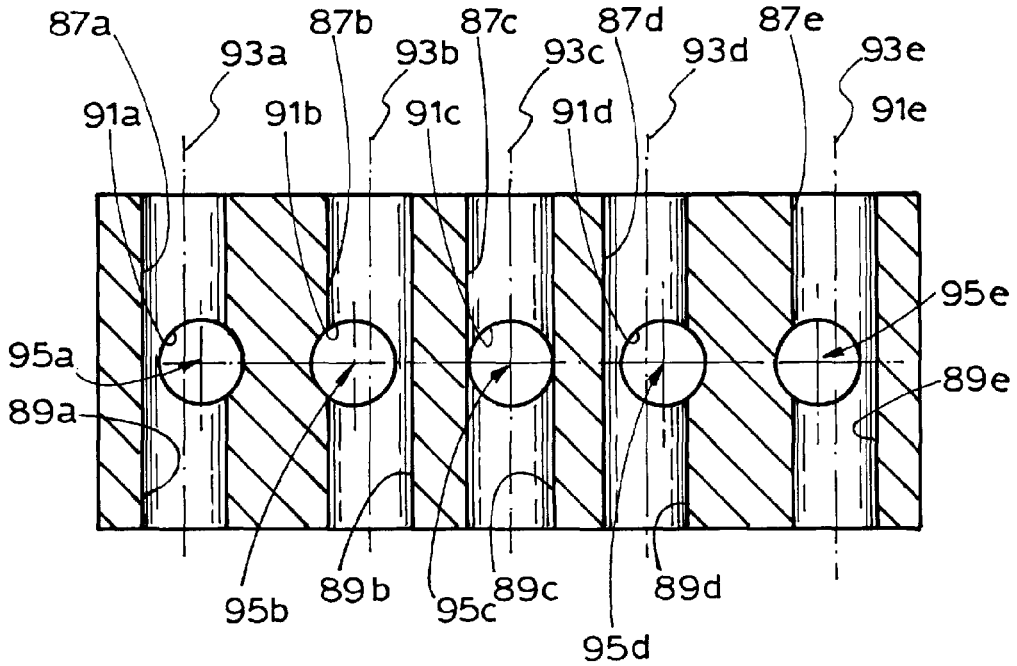

FIG. 14 is a similar view of the quint of FIG. 10, but illustrates the innermost lateral valve bore pairs being offset inwardly and the outermost lateral valve bore pairs being offset outwardly, and the central valve bore pair not being offset, from their respective plunger bores.

Figure 15:
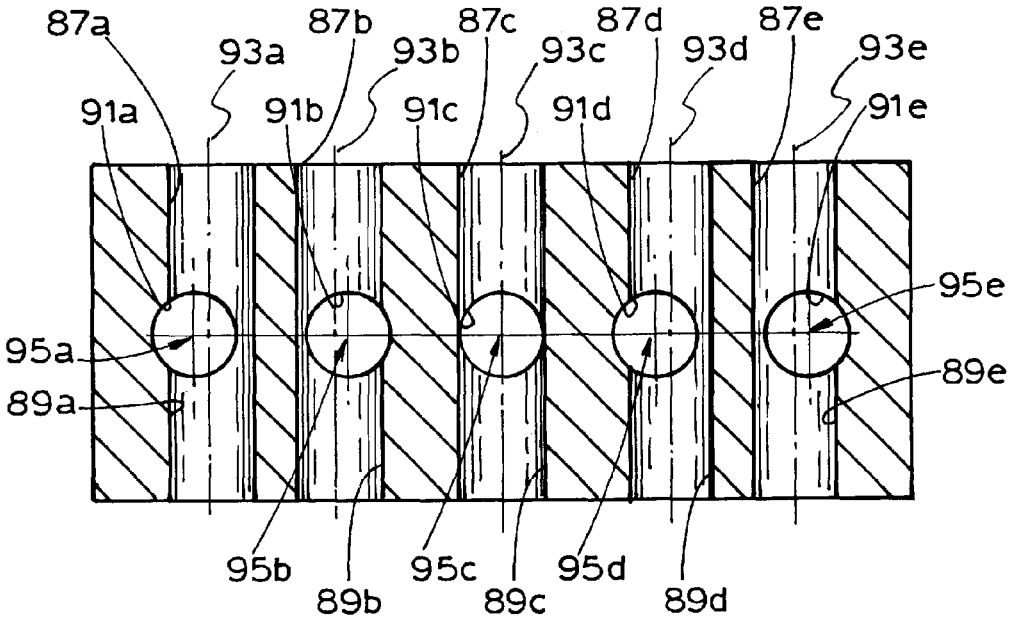

FIG. 15 is a similar view of the quint of FIG. 10, but illustrates the innermost lateral valve bore pairs being offset outwardly and the outermost lateral valve bore pairs being offset inwardly, and the central valve bore pair not being offset, from their respective plunger bores.

Figure 17:
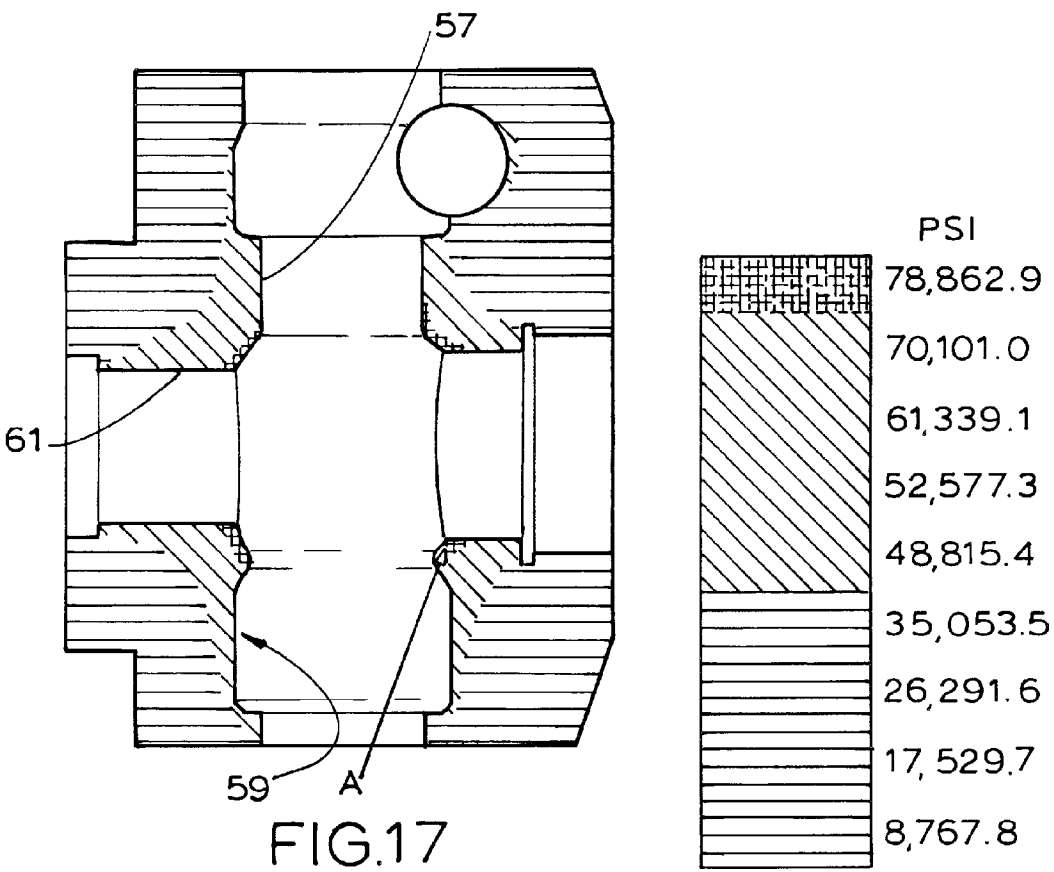
Figure 16:
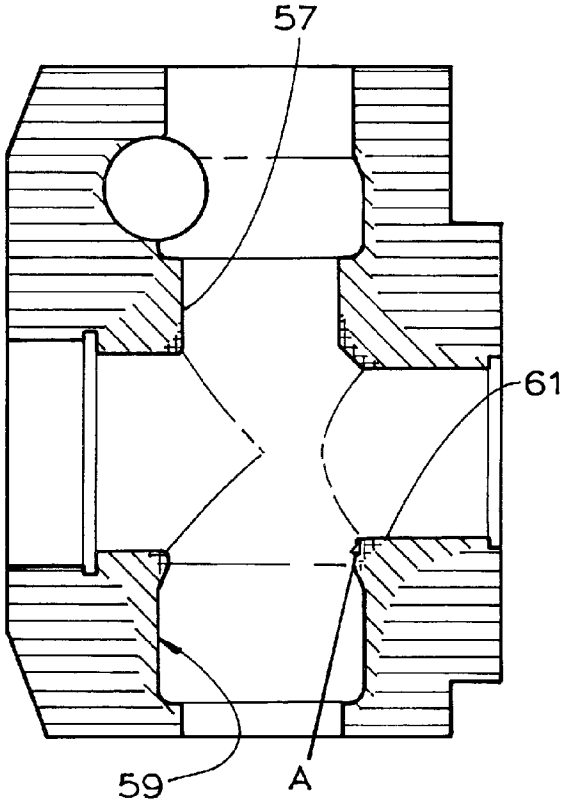

FIGS. 16 and 17 schematically depict side sectional elevations as generated by finite element analysis (FEA), and taken from opposite sides, through a triplex fluid end, to illustrate where maximum stress, as indicated by FEA, occurs for the intersection of a plunger bore with the suction and discharge valve bores; with FIG. 16 showing no offset and FIG. 17 showing 2 inch inward offset.

Figure 18:
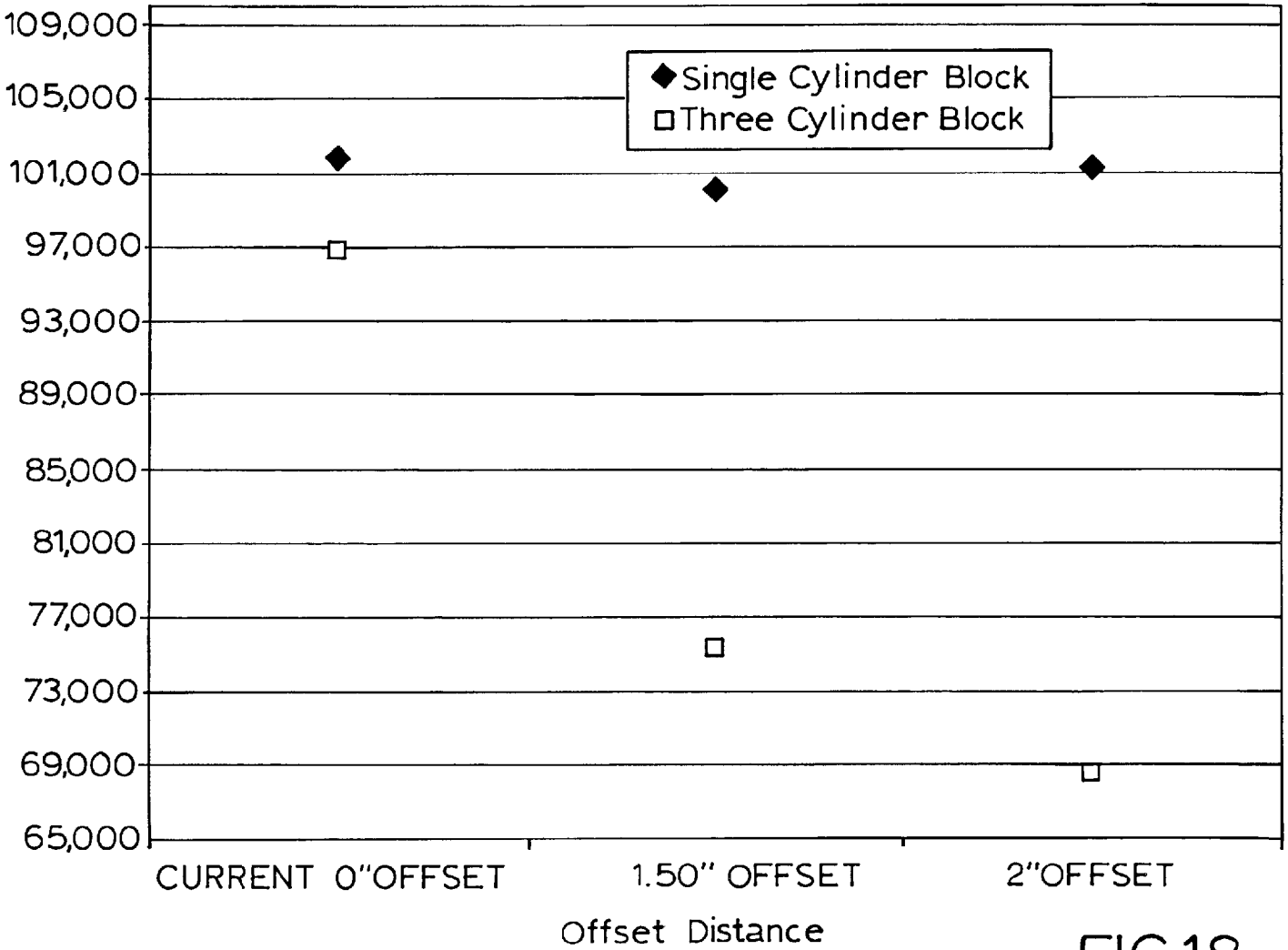

FIG. 18 is a data point graph that plot Von Mises yield criterion (that is, for the maximum stress, in psi, as determined by FEA) against the amount of valve bore offset (in inches) for a single (mono) fluid end and a triplex fluid end.

Figure 19:
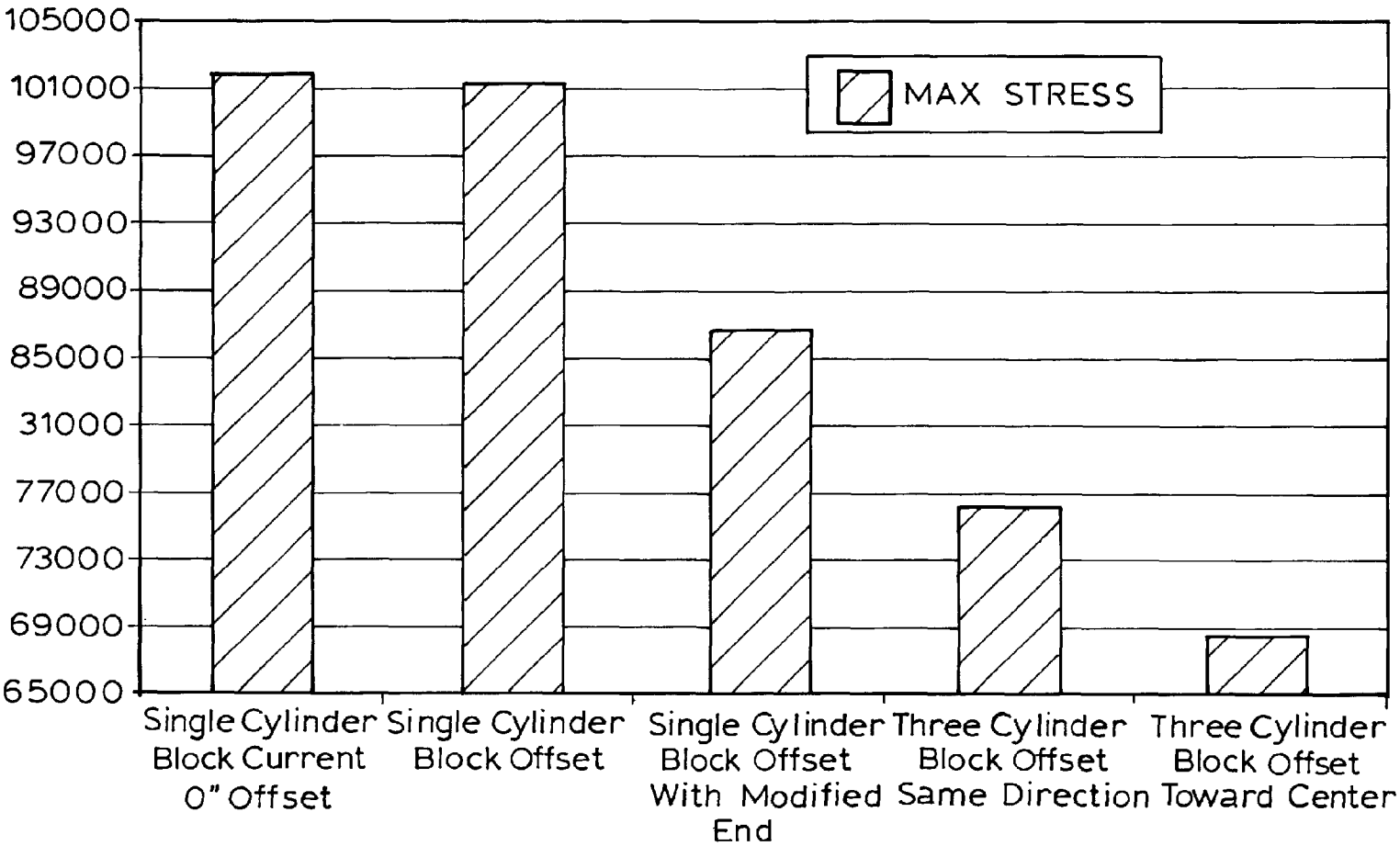
Figure 20:
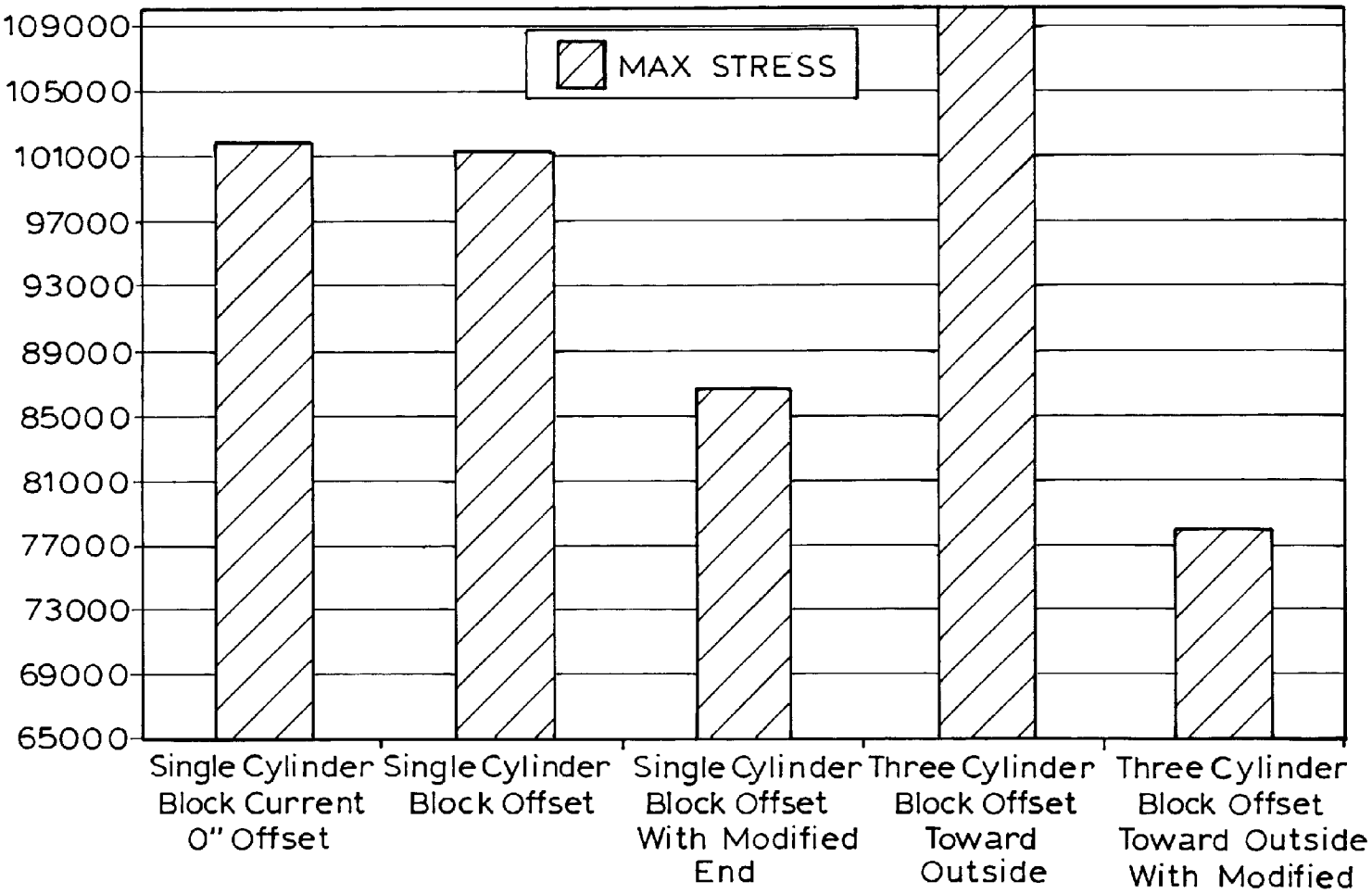

FIGS. 19 and 20 are two different bar graphs that plot Von Mises yield criterion (that is, for the maximum stress, in psi, as determined by FEA) against different amounts of valve bore offset (in inches), both inward and outward, for a single (mono) fluid end and a triplex fluid end.

DETAILED DESCRIPTION OF SPECIFIC EMBODIMENTS

Figure 1B:
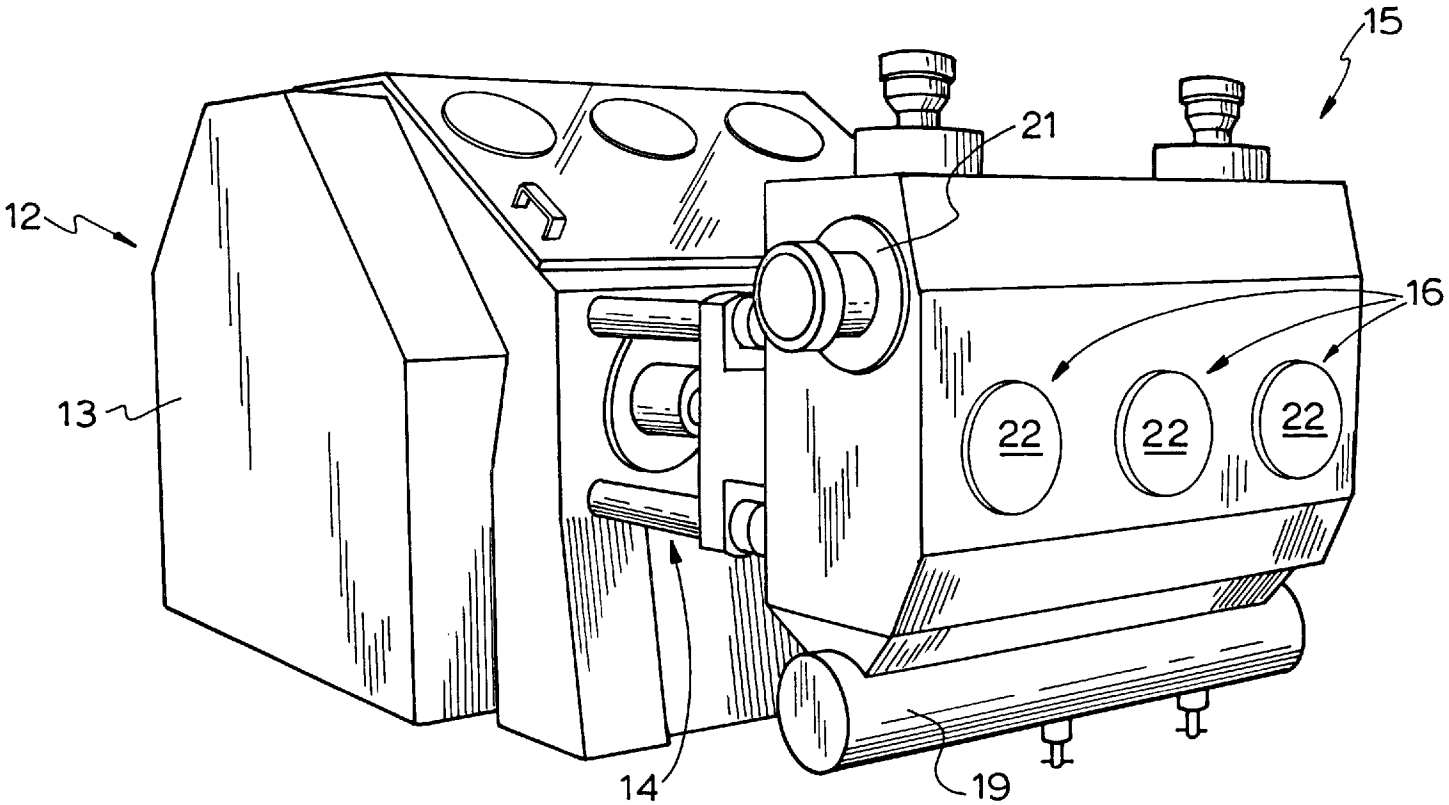

Referring to FIGS. 1A and 1B, an embodiment of a reciprocating pump 12 housed within a crankshaft housing 13 is shown. The crankshaft housing 13 may comprise a majority of the outer surface of reciprocating pump 12. Stay rods 14 connect the crankshaft housing 13 (the so-called "power end") to a fluid end 15. When the pump is to be used at high pressures (for instance, in the vicinity of 20,000 psi or greater), up to four stay rods can be employed for each plunger of the multiple reciprocating pump. The stay rods may optionally be enclosed in a housing.

The pump 12 is a triplex having a set of three cylinders 16, each including a respective plunger bore 17. The three (or, in the case of a quint, five) cylinders/plunger bores can be arranged transversely across the fluid end 15. A plunger 35 reciprocates in a respective plunger bore 17 and, in FIG. 1A, the plunger 35 is shown fully extended at its top dead centre position. In the embodiment depicted, fluid is only pumped at one side 51 of the plunger 35, therefore the reciprocating pump 12 is a single-acting reciprocating pump.

Each plunger bore 17 is in communication with a fluid inlet or suction manifold 19 and a fluid outlet side 20 in communication with a pump outlet 21 (FIG. 1B). A suction cover plate 22 for each cylinder 16 and plunger bore 17 is mounted to the fluid end 15 at a location that opposes the plunger bore 17. The pump 12 can be free-standing on the ground, can be mounted to a trailer that can be towed between operational sites, or mounted to a skid such as for offshore operations.

Crankshaft housing 13 encloses a crankshaft 25, which can be mechanically connected to a motor (not shown). The motor rotates the crankshaft 25 in order to drive the reciprocating pump 12. In one embodiment, the crankshaft 25 is cammed so that fluid is pumped from each cylinder 16 at alternating times. As is readily appreciable by those skilled in the art, alternating the cycles of pumping fluid from each of the cylinders 16 helps minimize the primary, secondary, and tertiary (et al.) forces associated with the pumping action.

A gear 24 is mechanically connected to the crankshaft 25, with the crankshaft 25 being rotated by the motor (not shown) through gears 26 and 24. A crank pin 28 attaches to the main shaft 23, shown substantially parallel to an axis $A_X$ of the crankshaft 25. A connector rod 27 is connected to the crankshaft 25 at one end. The other end of connector rod 27 is secured by a bushing to a crosshead or gudgeon pin 31, which pivots within a crosshead 29 in housing 30 as the crankshaft 25 rotates at the one end of the connector rod 27. The pin 31 also functions to hold the connector rod 27 longitudinally relative to the crosshead 29. A pony rod 33 extends from the crosshead 29 in a longitudinally opposite direction from the crankshaft 25. The connector rod 27 and the crosshead 29 convert rotational movement of the crankshaft 25 into longitudinal movement of the pony rod 33.

The plunger 35 is connected to the pony rod 33 for pumping the fluid passing through each cylinder 16. Each cylinder 16 includes an interior or cylinder chamber 39, which is where the plunger 35 compresses the fluid being pumped by reciprocating pump 12. The cylinder 16 also includes an inlet (or suction) valve 41 and an outlet (or discharge) valve 43. Usually the inlet and outlet valves 41, 43 are arranged in an opposed relationship in cylinder 16 and may, for example, lie on a common axis.

The valves 41 and 43 are usually spring-loaded and are actuated by a predetermined differential pressure. The inlet (suction) valve 41 actuates to control fluid flow from the fluid inlet 19 into the cylinder chamber 39, and the outlet (discharge) valve 43 actuates to control fluid flow from the cylinder chamber 39 to the outlet side 20 and thence to the pump outlet 21. Depending on the size of the pump 12, the plunger 35 may be one of a plurality of plungers, for example, three or five plungers may be utilized.

The plunger 35 reciprocates, or moves longitudinally, toward and away from the chamber 39, as the crankshaft 25 rotates. As the plunger 35 moves longitudinally away from the cylinder chamber 39, the pressure of the fluid inside the chamber 39 decreases, creating a differential pressure across the inlet valve 41, which actuates the valve 41 and allows the fluid to enter the cylinder chamber 39 from the fluid inlet 19. The fluid continues to enter the cylinder chamber 39 as the plunger 35 continues to move longitudinally away from the cylinder 17 until the pressure difference between the fluid inside the chamber 39 and the fluid in the fluid inlet 19 is small enough for the inlet valve 41 to actuate to its closed position.

As the plunger 35 begins to move longitudinally into the cylinder 16, the pressure on the fluid inside of the cylinder chamber 39 begins to increase. Fluid pressure inside the cylinder chamber 39 continues to increase as the plunger 35 approaches the chamber 39 until the differential pressure across the outlet valve 43 is large enough to actuate the valve 43 and allow the fluid to exit the chamber 39 through the fluid outlet 21.

The inlet valve 41 is located within a suction valve bore 59 and the outlet valve 43 is located within a discharge valve bore 57. In the embodiment depicted, both valve bores 57, 59 are in communication with, and extend orthogonally to the plunger bore 17. The valve bores 57, 59 as shown are also co-axial (that is, lying on a common axis, or with parallel axes), but they may be offset relative to each other as described below.

It should be noted that the opposing arrangement of the valve bores 57, 59 depicted in FIG. 1 is easier to manufacture (for example, by casting and machining), and is easier to maintain and easier to service than, for example, a perpendicular arrangement of the valve bores (that is, where the axes of the bores are perpendicular). In the opposing bores arrangement, the bores can be easily accessed, packed, unpacked, serviced, etc from under and above the fluid end, without interfering with inlet and outlet manifolds.

In addition, it is understood that, where stress reduction in the fluid end is desirable, the opposing arrangement of the valve bores 57, 59 may induce less stress in the fluid end, especially at high operating pressures of 20,000 psi or greater, when compared with a perpendicular or other angled bore arrangement.

In FIGS. 1A and 1B, the fluid end 15 is shown without an end support and can be from about 36 to about 45 inches in length as measured from the first and second opposing sides. An embodiment of the fluid end 15 provides that the length is about 36 inches or about 39 inches in length as measured from the first and second opposing sides. A quintuplex fluid end can be from about 60 inches to about 80 inches in length as measured from the first and second opposing sides. An embodiment of the quintuplex fluid end has a length of about 52 inches, 63 inches or about 70.5 inches.

Figure 1C:
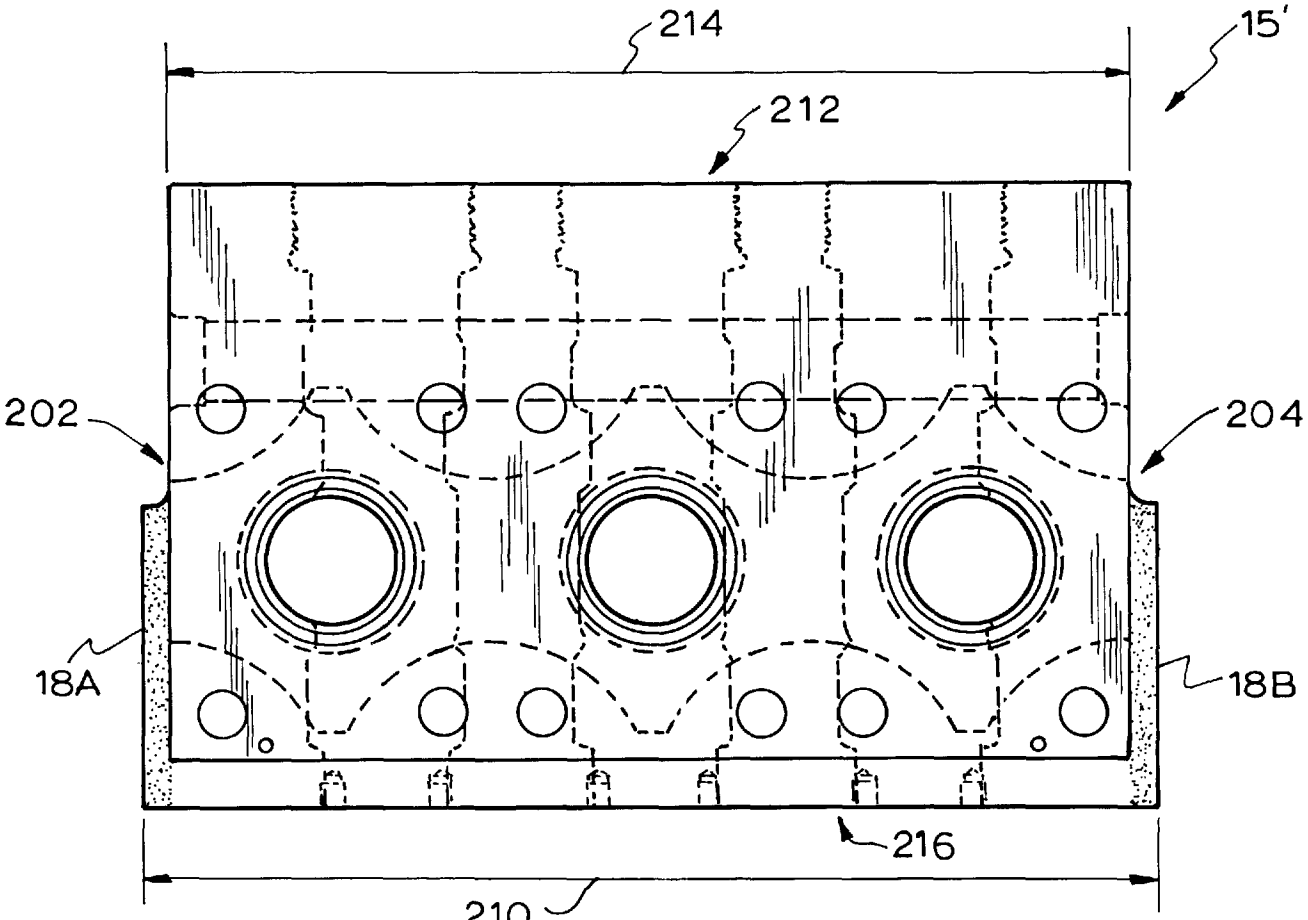
Figure 1D:
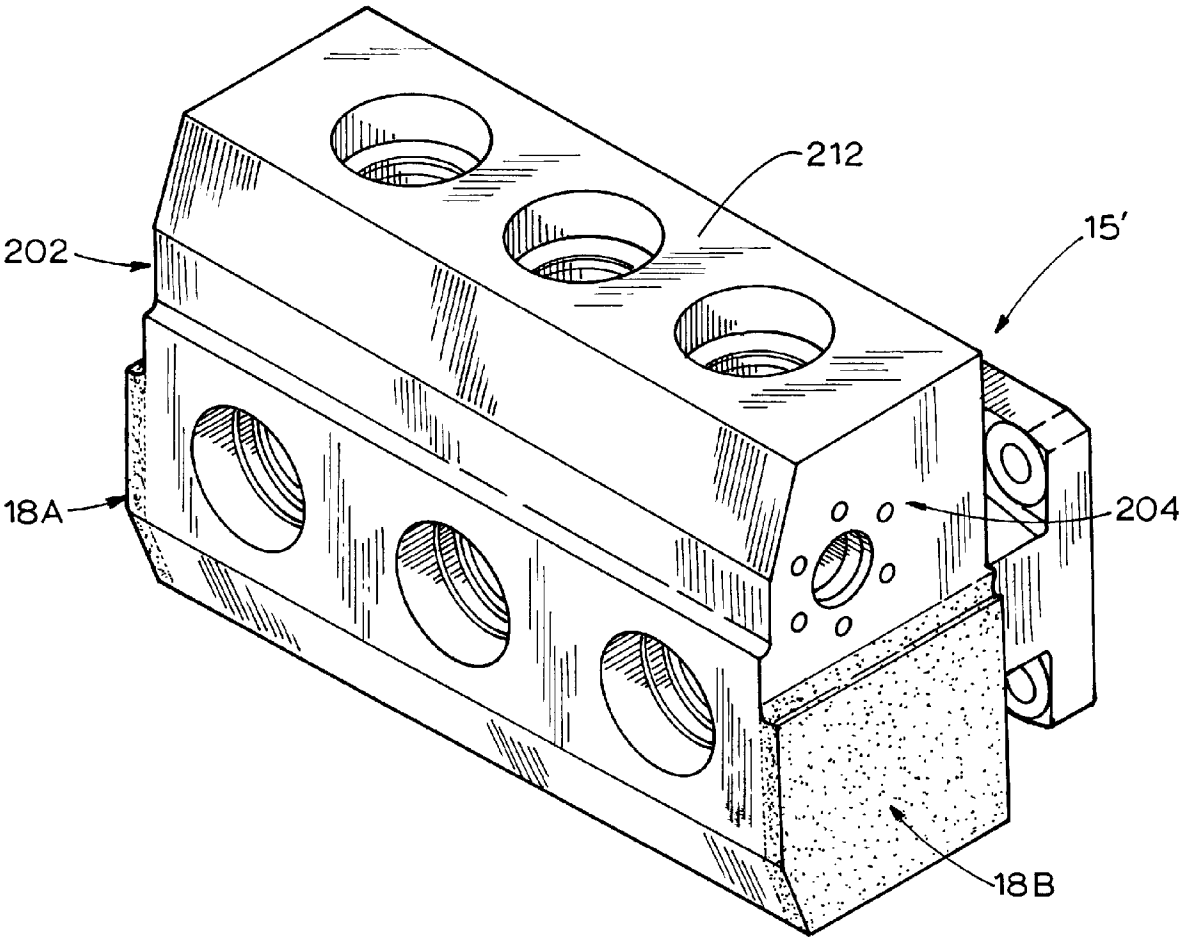

Referring now to FIGS. 1C and 1D, a triplex fluid end 15' for a reciprocating pump is illustrated. In these Figures the cover plates are removed for clarity. The fluid end 15' of FIGS. 1C and 1D comprises a modified end in comparison to the fluid end 15 of FIGS. 1A and 1B. In this regard, end supports in the form of additional material regions 18A and 18B have been added to opposing first 202 and second 204 sides of the fluid end 15'. In FIG. 1C the regions 18A and 18B are shown by stippling. The additional material may comprise the provision of extra metal in the fluid end during its manufacture (for example, by casting). However, there may be other ways of providing such end supports including bolt on plates, supporting framework, and so on.

The distance between the first and second opposing sides 202 and 204 defines a longitudinal dimension 210 for the fluid end 15'. The fluid end 15' also comprises a top surface 212 having a longitudinal dimension 214 and a bottom surface 216 having a longitudinal dimension 210. Because the additional material regions 18A and 18B are provided in a bottom portion of the first and second opposing sides 202 and 204, the longitudinal dimension 210 for the bottom surface 216 is greater than the longitudinal dimension 214 for the top surface 212. The longitudinal dimension 210 for a triplex fluid end 15' having an end support 18 can be greater than 35 inches to 40 inches, from about 36.1 inches to about 45 inches, from about 36.5 inches to about 39 inches, from about 37 inches to about 39 inches, is about 38 inches, or is about 39 inches. The longitudinal dimension 210 for a quintuplex fluid end having an end support 18 can be greater than 50 inches, greater than 52 inches, from about 50 inches to about 80 inches, from about 52.1 inches to about 85 inches, from about 71 inches to about 85 inches, is about 56 inches, is about 67 inches, or is about 74.5 inches.

This form of end support may be employed where, for example, one or both lateral (outside) valve bores 57, 59 are to be offset outwardly in the fluid end. In such an instance, the additional material in the regions 18A and 18B can function to reduce overall stress within the fluid end. Generally, if one of the lateral valve bores 57, 59 is offset outwardly in the fluid end then the additional material region 18A or 18B will be provided just at that end.

As depicted in the drawings, the additional material regions 18A and 18B may be dimensioned so as to add to the longitudinal dimension of the fluid end. For example, the increase in longitudinal dimension can range from about 0.1% to about 25% of the length of the fluid end (being the distance between first and second opposing sides).

As depicted in the drawings, the additional material regions 18A and 18B may be dimensioned so as to cover a proportion of the first and second opposing sides of the fluid end. For example, the regions 18A and 18B may each cover a proportion of its respective side in an amount ranging from about 20% to about 80%. As shown in FIG. 1D, each region 18A and 18B covers slightly greater than 50% of its respective side. However, if required, the regions 18A and 18B may each cover up to 100% of the first and second opposing sides of the fluid end.

As depicted in the drawings, the additional material regions 18A and 18B cover a lower part of their respective first and second opposing sides of the fluid end. This can correspond with a region or point of maximum stress arising from the outward offset of a lateral suction valve bore. As a result, the longitudinal dimension of the bottom part of the fluid end is greater than the longitudinal dimension of the top part of the fluid end.

Referring now to FIG. 2, a partial sectional view of the fluid end 15 of the pump 12 taken on the line 2-2 of FIG. 1A is schematically depicted. In the embodiment of FIGS. 2 and 3, the pump 12 is a triplex having three plunger bores 17 corresponding to three cylinder bores. However, as described hereafter with reference to FIGS. 10 to 15, the pump can have a different number of cylinders and plunger bores, such as five. For a symmetric triplex fluid end, a central bore of the three plunger bores lies on a central axis of the fluid end, with the other two plunger bores arranged evenly on either side of the central plunger bore. The offset may be with respect to a central axis of the fluid end.

In the embodiment of FIGS. 2 and 3 each of the three plunger bores 17 is indicated schematically with the reference numeral 61 (that is, 61*a*, 61*b* and 61*c*); each of the three suction valve bores is indicated schematically with the reference numeral 59 (i.e. 59*a*, 59*b* and 59*c*); and each of the three discharge valve bores is indicated schematically with the reference numeral 57 (that is, 57*a*, 57*b* and 57*c*). Similarly, the axis of each plunger bore 61 is indicated schematically with the reference numeral 65 (that is, 65*a*, 65*b* and 65*c*). Also, the common axis of each of the valve bores 59 and 57 is indicated schematically with the reference numeral 63 (that is, 63*a*, 63*b* and 63*c*). This nomenclature will also be used hereafter with reference to each of the different triplex fluid end embodiments described herein in FIGS. 2 to 9.

It has been discovered that the highest point of stress concentration in pump 12 occurs at the intersection of a plunger bore with the suction (or inlet) and discharge (or outlet) valve bores. The maximum stress in the fluid end occurs when one plunger (for example a lateral plunger) is approaching Top Dead Center (TDC), another is approaching Bottom Dead Center (BDC), and a third has just started moving from BDC to TDC.

It has further been discovered that, to reduce fluid end stress, some or all of the lateral (outside) valve bores 57*a*, 57*c*, 59*a*, 59*c* at the discharge and suction side may be inwardly offset so that an axis 65 of at least some of the plunger bores (that is, the lateral plunger bore axes 65*a* 65*c*) does not intersect with a common valve bore axis 63 such that at least one of the lateral valve bore axis 63*a* or 63*c* is inwardly offset from its respective lateral plunger bore axes 65*a* or 65*c*. This inward lateral offset has been observed to noticeably reduce the stress in the fluid end 15 that arises as a result of fluid flowing therein, especially at the high pressures that can be employed in oilfield operations (for example, with oil well fracking fluid).

In the three cylinder triplex pump embodiment of FIGS. 2 and 3 the lateral (or outside) suction and discharge valve bores 59*a*, 57*a* and 59*c*, 57*c* are each shown as being inwardly offset and to the same extent from the associated lateral (or outside) plunger bores 61*a* and 61*c*. The central discharge and suction valve bores 57*b*, 59*b* are not offset from their respective plunger bores 61*b*. Thus, the terminology "offset inwardly and to the same extent" can be considered as meaning offset inwardly in relation, or with reference, to the central plunger bore 61*b* and central valve bores 57*b*, 59*b*. In addition, the common axis 63*a* of the valve bores 59*a*, 57*a* is offset inwardly from the axis 65*a* of plunger bore 61*a*. Further, the common axis 63*c* of the valve bores 59*c*, 57*c* is offset inwardly and to the same extent from the axis 65*c* of the plunger bore 61*c*.

Furthermore, whilst in this embodiment the amount of inward offset from both the lateral plunger bores and axes toward the central plunger bore and axis is the same, the amount of offset can be different. For example, the suction and discharge valve bores on one side can be more or less laterally offset to that of the suction and discharge valve bores on the other side of the fluid end. Additionally, either or both of the suction and discharge valve bores on one side may be laterally offset by different extents, or one may not be offset at all, and this offset may be different to each of the suction and discharge valve bores on the other side of the fluid end, which also may be offset differently to each other.

In any case, the inward offsetting of both the lateral suction and discharge valve bores 59*a*, 57*a* and 59*c*, 57*c*, by the same amount and to the same extent, has been surprisingly observed to reduce stress within the fluid end at the high fluid operating pressures, as explained in Example 1.

As indicated above, in the three cylinder triplex pump embodiment of FIGS. 2 and 3, the common axis 63*b* of the central suction and discharge valve bores 59*b*, 57*b* intersects with axis 65*b* of the central plunger bore 61*b*. It has been observed that in a fluid end having three or more cylinders, there is less stress concentration at the intersection of the central plunger bore 61*b* with the central valve bores 57*b*, 59*b* as compared to the stress at the intersections of the lateral bores and their respective plungers, and hence offsetting the central valve bores 57*b*, 59*b* may not be required. However, the embodiments of FIGS. 5 and 6 provide that the central valve bores 59*b*, 57*b* and axes can also be offset (e.g. maybe to a lesser degree than the lateral bores) to reduce stress concentration thereat.

In the embodiment of FIGS. 2 and 3, each common axis 63 of the valve bores 57 and 59 extends perpendicularly to the plunger bore axis 65, although the lateral axes 63*a* and 63*c* do not intersect.

The amount of inward offset of the valve bores 59, 57 and the plunger bores 61 can be significant. For example, for 4.5 inch diameter bores, the valve bore 59, 57, may be inwardly offset 2 inches from a respective plunger bore 61. The amount of inward offset may be measured from axis to axis. For example, the distance can be set by referring to the distance that the common axis 63*a* or 63*c* of the valve bores 57*a* or 57*c* and 59*a* or 59*c* is offset either from its respective plunger bore axis 65*a* or 65*c*, or from the central plunger bore axis 65*b* (or where the central valve bore is not offset, as offset from the central common axis 63*b* of the valve bores 57*b* and 59*b*).

In any case, the amount of the offset can be about 40% of the diameter of the plunger bore, though it can, for example, range from about 10% to about 60%. Where the inward offset of each of the lateral valve bores 59*a*, 59*c* and 57*a*, 59*c* is 2 inches, the distance from axis 63*a* of valve bores 59*a*, 57*c* to axis 63*c* of valve bores 59*c*, 57*c* thus becomes 4 inches closer than in known fluid ends of similar dimensions.

In other embodiments, the inward offset of each lateral valve bore can range from about 0.25 inch to about 2.5 inch, from about 0.5 inch to about 2.0 inch, from about 0.75 inch to about 2.0 inch, from about 1 inch to about 2 inch, from about 0.25 inch to about 1.25 inch, from about 1.5 inch to about 2.5 inch, from about 1.5 inch to about 2.0 inch, or from about 1.5 inch to about 1.75 inch.

This moving of the lateral valve bores inwardly can represent a significant reduction in the overall dimension and weight of the fluid end. However, one limit to the amount of inward offset of the lateral (or outside) valve bores toward the central valve bore can be the amount of supporting metal between the valve bores.

When the lateral (or outside) suction valve bores 59 are inwardly offset as described with reference to FIG. 2, modification of the suction manifold 19 (FIGS. 1A and 1B) can allow for its easy connection to the new fluid end 15. Similar modifications can be employed for the discharge manifold.

A conventional suction manifold corresponds to conventional bolt patterns that would be located at a greater distance than that occurring between the valve bores 59*a*, 57*a*, to valve bores 59*c*, 57*c* depicted in FIG. 2. The new bolt pattern 71 is illustrated in FIG. 3, which schematically depicts an underside of the fluid end 15. In this regard, the distance 74 of the axis 63*a* of the valve bore 59*a* to the axis 63*c* of the valve bore 59*c* is shorter than the distance 72 between the axis 65*a* of the plunger bore 61*a* to the axis 65*c* of the plunger bore 61*c*, the latter of which corresponds to the conventional bolt pattern. It is feasible to modify and utilize a manifold with the new bolt pattern.

Referring now to the embodiment of FIGS. 4 and 5, the lateral (or outer) discharge and suction valve bores 57*a*, 59*a*, 57*c*, 59*c* are depicted as being offset outwardly from their respective plunger bores 61*a*, 61*c*. For example, the axis 63*a* of the valve bores 59*a*, 57*a* is outwardly offset from the axis 65*a* of the plunger bore 61*a*. Similarly, the axis 63*c* of the valve bores 59*c*, 57*c* is outwardly offset from the axis 65*c* of the plunger bore 61*c*. Although the amount of offset of the valve bores 59*a* and 59*c* depicted in FIGS. 4 and 5 are equal, each valve bore 59*a*, 59*c* may have a different offset.

The axis 63*b* of the central valve bores 57*b*, 59*b* is again shown intersecting with the axis 65*b* of the plunger bore 61*b*. However, the central valve bores 59*b*, 57*b* may also be offset. In the embodiment of FIGS. 4 and 5, as in the embodiment of FIGS. 2 and 3, the suction manifold 19 can be modified to connect to the new fluid end 15. The new bolt pattern 71' is illustrated in the underside view of the fluid end 15 in FIG. 5. In the new bolt pattern 71', the distance 74' from axis 63*a* of valve bore 59*a* to axis 63*c* of valve bore 59*c* is greater than the distance 72' between axis 65*a* of plunger bore 61*a* and axis 65*c* of plunger bore 61*c*, the latter of which is the conventional bolt pattern. Again, it is feasible to modify and utilize suction and discharge manifolds 19 with the new bolt pattern. However, where the amount of outward offset from the central valve bore is too close to the outer sides of the fluid end, this can cause an increase in stress as discussed hereafter with respect to the data of Example 2. This can be compensated for by adding a support end, such as the additional material regions 18A and 18B illustrated in FIGS. 1C and 1D, to the opposing end surfaces of the fluid end. The reduction in overall stress within the fluid end as a result of providing such support ends is also discussed hereafter with respect to the stress data of Example 2.

Referring now to the embodiment shown in FIGS. 6 and 7, the suction valve bores 59*a*, 59*b*, 59*c* and the discharge valve bores 57*a*, 57*b*, 57*c* corresponding to each plunger bore 61*a*, 61*b*, 61*c* are offset to one side (in this case to the left of the fluid end) and to the same extent, or alternatively may be offset to the right (not shown). Thus, the common axis 63 (i.e. 63*a*, 63*b*, 63*c*) of each of the valve bores 59, 57 is offset to the left of an axis 65 (i.e. 65*a*, 65*b*, 65*c*) of each respective plunger bore 61. Due to the uniform offset of the valve bores 59, 57 associated with each of the plunger bores 61, a bolt patterns 77 can also be spaced uniformly. The distance 78 from the common axis 63*a* of the valve bores 59*a*, 57*a* to the common axis 63*c* of the valve bores 59*c*, 57*c* is equal to the distance 79 between the axis 65*a* of the plunger bore 61*a* to the axis 65*c* of the plunger bore 61*c*, the latter of which is the conventional bolt pattern. Thus, in this embodiment, a conventional suction manifold 19 (FIG. 1) may be bolted onto the fluid end 15 depicted in FIG. 7.

In another embodiment shown in FIG. 8, the discharge valve bores 57*a*, 57*b*, 57*c* are shown being offset to the same extent to the right (or to the left—not shown) while the suction valve bores 59*a*, 59*b*, 59*c* remain aligned with each plunger bore 61*a*, 61*b*, 61*c*. Thus, an axis 63' of each of the discharge valve bores 57 is offset to the right of an axis 65 of each respective plunger bore 61, whereas the axis 63" of each suction valve bore 59 intersects the axis 65 of its respective plunger bore 61. Due to the uniform offset of the discharge valve bores 57 associated with each of the plunger bores 61, the bolt patterns are also spaced uniformly. In this regard, the distance 81 from the axis 63'*a* of the valve bore 57*a* to the axis 63'*c* of the valve bore 57*c* is equal to the distance 82 between the axis 65*a* of the plunger bore 61*a* to the axis 65*c* of the plunger bore 61*c*, the latter of which is the conventional bolt pattern. Thus, the fluid end of this embodiment employs a conventional discharge manifold set up. In this embodiment, the offset of at least one of the valve bores, here the discharge valve bores 57, can again provide a reduction in stress within the fluid end at the cross bore intersections.

In another embodiment shown in FIG. 9, the suction valve bores 59*a*, 59*b*, 59*c* can be offset by the same extent to the right (or to the left—not shown) while the discharge valve bores 57*a*, 57*b*, 57*c* remain aligned with each plunger bore 61*a*, 61*b*, 61*c*. Thus, an axis 63" of each of the suction valve bores 59 is offset to the right of an axis 65 of each respective plunger bore 61, whereas the axis 63' of each discharge, valve bore 57 intersects the axis 65 of its respective plunger bore 61. Due to the uniform offset of the discharge valve bores 57 associated with each of the plunger bores 61, the bolt patterns are also spaced uniformly. In this regard, the distance 83 from an axis 63"*a* of the valve bore 59*a* to an axis 63"*c* of the valve bore 59*c* is equal to the distance 84 between an axis 65*a* of the plunger bore 61*a* to the axis 65*c* of the plunger bore 61*c*, the latter of which is the conventional bolt pattern. Thus, a conventional suction manifold 19 (FIG. 1) may be bolted onto the fluid end 15. As with the embodiment described in FIG. 8, the offset of at least one of the valve bores, here the suction valve bore 59, can provide a reduction in stress at the cross bores of the fluid end 15.

It should be noted that the offsetting of just the discharge valve bores 57, or the offsetting of just the suction valve bores 59, can also be employed in a quint fluid end set-up.

Referring now to FIGS. 10 and 11, a first embodiment of a quint fluid end (that is, a quintuplex fluid end having five plungers, five suction valves and five discharge valve bores) is shown. FIG. 10 is a partial section of FIG. 1A taken on the line 2-2 (i.e. noting that FIG. 1A can also relate to a quint). FIG. 11 is an underside schematic view of the section of FIG. 10 to show a bolt pattern on a fluid end. For a symmetrical quint fluid end, a central bore of the five plunger bores lies on a central axis of the fluid end, with two plunger bores arranged evenly on either side of the central plunger bore. Again, offset may be with respect to a central axis of the fluid end.

In the embodiment of FIGS. 10 and 11 each of the five plunger bores 17 is indicated schematically with the reference numeral 91 (that is, 91*a*, 91*b*, 91*c*, 91*d* and 91*e*); each of the three suction valve bores is indicated schematically with the reference numeral 89 (that is, 89*a*, 89*b*, 89*c*, 89*d* and 89*e*); and each of the three discharge valve bores is indicated schematically with the reference numeral 87 (that is, 87*a*, 87*b*, 87*c*, 87*d* and 87*e*). Similarly, the axis of each plunger bore 91 is indicated schematically with the reference numeral 95 (that is, 95*a*, 95*b*, 95*c*, 95*d* and 95*e*). Also, the common axis of each of the valve bores 89, 87 is indicated schematically with the reference numeral 93 (that is, 93*a*, 93*b*, 93*c*, 93*d* and 93*e*). This nomenclature will also be used hereafter with reference to the different quint fluid end embodiments described herein.

In the quint fluid end embodiment of FIGS. 10 and 11 the two lateral valve bores 89*a* and 87*a*; 89*b* and 87*b*; 89*d* and 87*d*; 89*e* and 87*e* on each side of the central valve bores 89*c* and 87*c* are shown as being inwardly offset from their respective plunger bores 91*a*, 91*b*, 91*d* and 91*e*.

In the embodiment of FIGS. 10 and 11 each of the two lateral valve bores on either side of the central valve bores is inwardly offset by the same amount and to the same extent. However, with a quint fluid end, many more variations and offset combinations are possible than with a triplex fluid end. For example, just two of the lateral discharge valve bores 87*a* and 87*b* (and not their respective suction valve bores 89*a* and 89*b*) may be inwardly offset, and these two discharge valve bores 87*a* and 87*b* may each be offset by the same or different amounts. This inward offset may not be employed for the opposite two lateral discharge valve bores 87*d* and 87*e*. The inward offset may be employed for the opposite two lateral suction valve bores 89*a* and 89*b*, which latter two might also each be offset by the same or by different amounts, and so on.

Referring to the new bolt pattern of FIG. 11, modification of the suction manifold can allow for its easy connection to the new quint fluid end. As mentioned above, a conventional suction manifold corresponds to conventional bolt patterns that are located at a greater distance than that occurring between the valve bores 89*a*, 87*a*, to valve bores 89*e*, 87*e* depicted in FIG. 11. The new bolt pattern 101 is illustrated in FIG. 11, which schematically depicts an underside of the fluid end 15. In this regard, the distance 104 of the axis 93*a* of the valve bore 89*a* to the axis 93*e* of the valve bore 89*e* is shorter than the distance 102 between the axis 95*a* of the plunger bore 91*a* to the axis 95*e* of the plunger bore 91*e*, the latter of which corresponds to the conventional bolt pattern. Again, it is feasible to modify and utilize a manifold with the new bolt pattern.

Referring now to FIG. 12, another embodiment of a quint fluid end is shown. FIG. 12 shows a similar view to the quint of 10, but in this embodiment illustrates the outward offsetting from their respective plunger bores 91*a*, 91*b*, 91*d* and 91*e* of the outermost and innermost lateral valve bores 89*a*, 87*a*, 89*b*, 87, 89*d*, 87*d* and 89*e*, 87*e* on each side of the non-offset central valve bores 89*c* and 87*c*.

Referring now to FIG. 13, yet another embodiment of a quint fluid end is shown. FIG. 13 shows a similar view to the quint of FIG. 10, but in this embodiment illustrates the offsetting to the left, (although it may be, to the right) of each of the valve bores 89, 87.

Referring now to FIG. 14, yet a further embodiment of a quint fluid end is shown. FIG. 14 shows a similar view to the quint of FIG. 10, but in this embodiment illustrates the inward offsetting from their respective plunger bores 91*b* and 91*d* of the innermost lateral valve bores 89*b*, 87*b* and 89*d*, 87*d*, and the outward offsetting of the outermost lateral valve bores 89*a*, 87*a* and 89*e*, 87*e*. The central valve bores 89*c*, 87*c* are not offset.

Referring now to FIG. 15, a yet further embodiment of a quint fluid end is shown. FIG. 15 shows a similar view to the quint of FIG. 10, but in this embodiment illustrates the outward offsetting from their respective plunger bores 91*b* and 91*d* of the innermost lateral valve bores 89*b*, 87*b* and 89*d*, 87*d*, and the inward offsetting of the outermost lateral valve bores 89*a* and 87*a*, and 89*e* and 87*e*. Again, the central valve bores 89*c* and 87*c* are not offset.

Whilst not shown, with the quint fluid end many other combinations of valve bore offsets are possible, and material (metal) within the fluid end may be adjusted accordingly.

EXAMPLES

Non-limiting examples are provided to illustrate how the offsetting of a lateral valve bore can surprisingly and unexpectedly reduce stress in a fluid end during operation at high pressures as compared to a fluid end having conventional unmodified valve bores. Example 1 discusses data modeled for an inward offsetting, and Example 2 discusses data modeled for an outward offsetting. In the following examples, finite element analysis (FEA) tests were conducted for a triplex fluid end, although it was noted that the findings also applied to a quintuplex fluid end.

The FEA experiments were conducted to compare the stresses induced in a number of new fluid end configurations having three cylinders against a known (existing and unmodified) three cylinder fluid end configuration. In the unmodified fluid end configuration the axis of each plunger bore intersected perpendicularly with a common axis of the suction and discharge valve bores.

In these FEA stress tests, each fluid end was subjected to a working fluid pressure of 15,000 psi, commensurate with that experienced in usual applications. The pressure of fluid in the lateral discharge bore was observed by FEA to be 16,800 psi.

FIGS. 16 and 17 show two of the schematics of a triplex fluid end that were generated by FEA at these model fluid pressures. In FIGS. 16 and 17 regions of stress are shaded according to the key adjacent to FIG. 17. The view in FIG. 16 is from one side of the fluid end and shows no offset of the suction and discharge valve bores 59 and 57. The head of the arrow A illustrates where maximum stress occurred at the intersection of the plunger bore 61 with the suction valve bore 59 (that is, where the plunger bore 61 first intersects with the suction valve bore 59). This indicates that, in operation, stress in the fluid end may be reduced, for example, by offsetting just one of the suction valve bores 59. However, greater stress reduction may also be achieved by offsetting of the opposing lateral suction and discharge valve bores 59 and 57.

The view in FIG. 17 is from an opposite side of the fluid end and shows a 2 inch inward offset of the discharge and suction valve bores 57 and 59. The offset was measured from the centerline of the respective plunger bore 65*a*, 65*c*. The head of the arrow A illustrates where maximum stress occurred at the intersection of the plunger bore 61 with the suction valve bore 59 (i.e. where the suction valve bore 59 intersects with the extension of the plunger cylinder which terminates at the suction cover plate 22). In other words, the region of maximum concentrated stress has been shifted out of the intersection of the plunger bore 61 with the suction valve bore 59.

Example 1

Inward Offsetting

In the first set of tests a single (or mono) block fluid end and a triplex fluid end were each modeled. The single block fluid end was modeled with one of the valve bores offset and an end was modified with an end support. With the triplex fluid end one of the lateral (outside) valve bores was inwardly offset, as compared with a triplex pump in which both lateral valve bores may be inwardly offset. The fluid end configurations modeled included one (e.g. lateral) discharge 57 and suction 59 bore being inwardly offset by 1.5 inches and by 2 inches.

The stress result modeled by FEA was correlated to the Von Mises yield criterion (in psi) and the results were plotted for each of zero offset (that is, an existing fluid end), and 1.5 inches and 2 inches offset (that is, a new fluid end) and offset with an end support. The results are shown in the graphs of FIG. 18 (which shows data point results for both 1.5 inches and 2 inches offset) and FIG. 19 (which represents the results for 1.5 inches and 2 inches inward offset in a bar chart).

As can be seen, the FEA modeling of the tested fluid ends resulted in a 2 inch inward offset of a triplex fluid end having the greatest amount of stress reduction as compared to no offset and to 1.5 inches inward offset for the triplex or single block. Moreover, the single block fluid end with an offset surprisingly did not produce much of reduction in stress. However, as soon as the end was modified with the end support that was 2 inches in length (or thickness) and extended along the entire exterior end the stress dropped noticeably (FIG. 19). The overall stress reduction in the triplex fluid end for a 2 inch inward offset was noted to be approximately 30% (that is, from ~97,000 psi to less than 69,000 psi as shown in FIGS. 18 and 19). It was noted that such a stress reduction would be likely to significantly extend the useful operating life of the fluid end.

Example 2

Outward Offsetting

In the second set of tests, the outward offsetting of one of the lateral (outside) valve bores was modeled. The fluid end configurations tested included one lateral suction 57 and suction 59 bore being outwardly offset by 1.5 inches and by 2 inches. The results for a 2 inch offset are shown in FIG. 20. For a 2 inch outward offset in a triplex, with no adjustment for a resultant thinning in adjacent wall material, the FEA modeling resulted in an increase in stress at the intersection of plunger and valve bores ($2^{nd}$ rightmost bar). However, in the FEA model, as soon as the wall was modified with an end support that was 2 inches in length (or thickness) extending along the entire surface of the outer wall (see e.g. FIGS. 1C and 1D), the overall stress reduction in the fluid end was around 29% (from ~97,000 psi to less than 69,000 psi). Again, it was noted that such a stress reduction would be likely to significantly extend the useful operating life of the fluid end.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below", "top" and "bottom" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the fluid end and reciprocating pump, and alterations, modifications, additions and/or changes can be made thereto without departing from the scope and spirit of the disclosed embodiments, the embodiments being illustrative and not restrictive.

Furthermore, the fluid end and reciprocating pump have described in connection with what are presently considered to be the most practical and preferred embodiments, it is to be understood that the fluid end and reciprocating pump are not to be limited to the disclosed embodiments, but on the contrary, is intended to cover various modifications and equivalent arrangements included within the spirit and scope of the disclosure. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A fluid end for a multiple reciprocating pump assembly, the fluid end comprising:

at least three cylinder chambers;

at least three respective plunger bores in fluid communication with the cylinder chambers, each plunger bore for receiving a reciprocating plunger, each plunger bore having a plunger bore axis, the plunger bores being arranged across the fluid end to define a central plunger bore and lateral plunger bores located on either side of the central plunger bore;

at least three respective suction valve bores in fluid communication with the cylinder chambers, each suction valve bore for receiving a suction valve and having a suction valve bore axis; and at least three respective discharge valve bores in fluid communication with the cylinder chambers, each discharge valve bore for receiving a discharge valve and having a discharge valve bore axis;

wherein each of the plunger bores, the suction valve bores, and the discharge valve bores intersects with its respective cylinder chamber; and wherein at least one of the axes of at least one of the suction and discharge valve bores for at least one of the lateral plunger bores is offset from its respective plunger bore axis within its respective cylinder chamber.

2. A fluid end according to claim 1 wherein, for each of the plunger bores, the suction valve bore opposes the discharge valve bore.

3. A fluid end according to claim 1 or 2 wherein, for each of the plunger bores, the axes of the suction and discharge valve bores are aligned.

4. A fluid end according to any one of the preceding claims wherein the at least one offset axis is offset in an amount ranging from about 10% to about 60% of the diameter of the plunger bore.

5. A fluid end according to any one of the preceding claims wherein the at least one offset axis is offset in an amount ranging from about 20% to about 50% of the diameter of the plunger bore.

6. A fluid end according to any one of the preceding claims wherein the at least one offset axis is offset in an amount ranging from about 30% to about 40% of the diameter of the plunger bore.

7. A fluid end according to any one of claims 1 to 3 wherein the at least one offset axis is offset in an amount ranging from about 0.5 to about 2.5 inches.

8. A fluid end according to claim 7 wherein the at least one offset axis is offset in an amount ranging from about 1.5 to about 2.5 inches.

9. A fluid end for a multiple reciprocating pump assembly, the fluid end comprising:

at least three cylinder chambers;

at least three respective plunger bores in fluid communication with the cylinder chambers, each plunger bore for receiving a reciprocating plunger, each plunger bore having a plunger bore axis, the plunger bores being arranged across the fluid end to define a central plunger bore and lateral plunger bores located on either side of the central plunger bore;

at least three respective suction valve bores in fluid communication with the cylinder chambers, each suction valve bore for receiving a suction valve and having a suction valve bore axis; and at least three respective discharge valve bores in fluid communication with the cylinder chambers, each discharge valve bore for receiving a discharge valve and having a discharge valve bore axis;

wherein each of the plunger bores, the suction valve bores, and the discharge valve bores intersects with its respective cylinder chamber; and wherein at least one of the axes of at least one of the suction and discharge valve bores for at least one of the lateral plunger bores is offset from its respective plunger bore axis within its respective cylinder chamber in such a manner that overall stress within the fluid end in use is reduced.

10. A fluid end according to claim 9 wherein, for each of the plunger bores, the suction valve bore opposes the discharge valve bore.

11. A fluid end according to claim 9 or 10 wherein, for each of the plunger bores, the axes of the suction and discharge valve bores are aligned.

12. A fluid end according to any one of claims 9 to 11 wherein the at least one offset axis is inwardly offset in an amount ranging from about 10% to about 60% of the diameter of the plunger bore.

13. A fluid end according to any one of claims 9 to 12 wherein the at least one offset axis is offset in an amount ranging from about 20% to about 50% of the diameter of the plunger bore.

14. A fluid end according to any one of claims 9 to 13 wherein the at least one offset axis is offset in an amount ranging from about 30% to about 40% of the diameter of the plunger bore.

15. A fluid end according to any one of claims 9 to 11 wherein the at least one offset axis is offset in an amount ranging from about 0.5 to about 2.5 inches.

16. A fluid end according to claim 15 wherein the at least one offset axis is offset in an amount ranging from about 1.5 to about 2.5 inches.

17. A fluid end for a multiple reciprocating pump assembly, the fluid end comprising:

at least three cylinder chambers;

at least three respective plunger bores in fluid communication with the cylinder chambers, each plunger bore for receiving a reciprocating plunger, each plunger bore having a plunger bore axis, the plunger bores being arranged across the fluid end to define a central plunger bore and lateral plunger bores located on either side of the central plunger bore;

at least three respective suction valve bores in fluid communication with the cylinder chambers, each suction valve bore for receiving a suction valve and having a suction valve bore axis; and at least three respective discharge valve bores in fluid communication with the cylinder chambers, each discharge valve bore for receiving a discharge valve and having a discharge valve bore axis, and each opposing a respective suction valve bore;

wherein each of the plunger bores, the suction bores, and the discharge valve bores intersects with its respective cylinder chamber; and wherein at least one of the axes of at least one of the suction and discharge valve bores for at least one of the lateral plunger bores is offset from its respective plunger bore axis within its respective cylinder chamber.

18. A fluid end according to claim 17 wherein, for each of the plunger bores, the axes of the suction and discharge valve bores are aligned.

19. A fluid end according to claim 17 or 18 wherein the at least one offset axis is inwardly offset in an amount ranging from about 10% to about 60% of the diameter of the plunger bore.

20. A fluid end according to any one of claims 17 to 19 wherein the at least one offset axis is offset in an amount ranging from about 20% to about 50% of the diameter of the plunger bore.

21. A fluid end according to any one of claims 17 to 20 wherein the at least one offset axis is offset in an amount ranging from about 30% to about 40% of the diameter of the plunger bore.

22. A fluid end according to claim 17 or 18 wherein the at least one offset axis is offset in an amount ranging from about 0.5 to about 2.5 inches.

23. A fluid end according to claim 22 wherein the at least one offset axis is offset in an amount ranging from about 1.5 to about 2.5 inches.

24. A fluid end according to any one of the preceding claims wherein at least one of the axes of the suction and discharge valve bores for each of the lateral plunger bores is inwardly or outwardly offset.

25. A fluid end according to claim 24 wherein the axes of both the suction and discharge valve bores are inwardly or outwardly offset to the same extent.

26. A fluid end for a multiple reciprocating pump assembly, the fluid end comprising:

first and second opposing sides having a longitudinal dimension, first and second opposing end surfaces, a top surface having a longitudinal dimension, and a bottom surface having a longitudinal dimension;

at least three cylinder chambers;

at least three respective plunger bores in fluid communication with the cylinder chambers, each plunger bore for receiving a reciprocating plunger, each plunger bore having a plunger bore axis, the plunger bores being arranged across the fluid end to define a central plunger bore and lateral plunger bores located on either side of the central plunger bore;

at least three respective suction valve bores in fluid communication with the cylinder chambers, each suction valve bore for receiving a suction valve and having a suction valve bore axis; and at least three respective discharge valve bores in fluid communication with the cylinder chambers, each discharge valve bore for receiving a discharge valve and having a discharge valve bore axis;

wherein each of the plunger bores, the suction valve bores, and the discharge valve bores intersects with its respective cylinder chamber; and wherein at least one of the axes of at least one of the suction and discharge valve bores for at least one of the lateral plunger bores is offset from its respective plunger bore axis within its respective cylinder chamber.

27. A fluid end according to claim 26 wherein, for each of the plunger bores, the suction valve bore opposes the discharge valve bore.

28. A fluid end according to claim 26 or 27 wherein, for each of the plunger bores, the axes of the suction and discharge valve bores are aligned.

29. A fluid end according to any one of claims 26 to 28 wherein the at least one offset axis is offset in an amount ranging from about 10% to about 60% of the diameter of the plunger bore.

30. A fluid end according to any one of claims 26 to 29 wherein the at least one offset axis is offset in an amount ranging from about 20% to about 50% of the diameter of the plunger bore.

31. A fluid end according to any one of claims 26 to 30 wherein the at least one offset axis is offset in an amount ranging from about 30% to about 40% of the diameter of the plunger bore.

32. A fluid end according to any one of claims 26 to 28 wherein the at least one offset axis is offset in an amount ranging from about 0.5 to about 2.5 inches.

33. A fluid end according any one of claims 26 to 32 wherein at least one of the first and second end surfaces further comprises an end support.

34. A fluid end according to claim 33, wherein the end support adds from about 0.1% to about 25% to a portion of the longitudinal dimension of the first and second opposing sides.

35. A fluid end according to claim 33 or 34 wherein the end support covers from about 20% to about 80% of the surface on at least one of the first and second ends.

36. A fluid end according to any one of claims 33 to 35 wherein the longitudinal dimension of the bottom surface is greater than the longitudinal dimension of the top surface.

* * * * *